US012085328B2

(12) United States Patent
Kim et al.

(10) Patent No.: US 12,085,328 B2
(45) Date of Patent: Sep. 10, 2024

(54) REFRIGERATOR HAVING HEATER IN DUCT BETWEEN COMPARTMENTS

(71) Applicant: LG ELECTRONICS INC., Seoul (KR)

(72) Inventors: Kihwang Kim, Seoul (KR); Yong Bum Cho, Seoul (KR); Dong Hwi Kim, Seoul (KR); Hyeon Seong Lee, Seoul (KR); Won Ho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

(21) Appl. No.: 17/585,939

(22) Filed: Jan. 27, 2022

(65) Prior Publication Data

US 2022/0282901 A1 Sep. 8, 2022

(30) Foreign Application Priority Data

Mar. 4, 2021 (KR) ..... 10-2021-0028655

(51) Int. Cl.

| | |
|---|---|
| ***F25D 21/08*** | (2006.01) |
| ***F25D 17/04*** | (2006.01) |
| ***F25D 17/06*** | (2006.01) |
| ***F25D 21/04*** | (2006.01) |

(52) U.S. Cl.

CPC ..... *F25D 21/08* (2013.01); *F25D 17/045* (2013.01); *F25D 17/062* (2013.01); *F25D 21/04* (2013.01); *F25D 2317/067* (2013.01); *F25D 2323/021* (2013.01); *F25D 2400/02* (2013.01)

(58) Field of Classification Search

CPC ..... F25D 21/08; F25D 17/045; F25D 17/062; F25D 21/04; F25D 2400/02; F25D 2317/0667

See application file for complete search history.

(56) References Cited

U.S. PATENT DOCUMENTS

| | | | | |
|---|---|---|---|---|
| 3,759,053 | A * | 9/1973 | Swaneck, Jr. | F25D 17/065 62/157 |
| 10,670,324 | B2 | 6/2020 | Besore et al. | |
| 2016/0363367 | A1* | 12/2016 | Hitzelberger | C25D 5/56 |
| 2017/0059228 | A1* | 3/2017 | Hu | F25B 13/00 |
| 2017/0314841 | A1* | 11/2017 | Koo | F25D 11/02 |
| 2018/0224183 | A1* | 8/2018 | Besore | F25D 17/065 |

(Continued)

FOREIGN PATENT DOCUMENTS

| | | | |
|---|---|---|---|
| EP | 2 339 275 | 6/2011 | |
| EP | 4 053 478 A1 | 9/2022 | |
| JP | 2020118341 A * | 8/2020 | F25D 11/02 |

(Continued)

OTHER PUBLICATIONS

JP-2020118341-A Translation (Year: 2020).*

(Continued)

*Primary Examiner* — David J Teitelbaum

(74) *Attorney, Agent, or Firm* — KED & Associates LLP

(57) ABSTRACT

A refrigerator is proposed. Due to a first heater provided in a damper assembly, a damper assembly or the connection portion of the damper assembly with a supply duct is prevented from freezing, and due to a second heater provided in the supply duct, the connection portion of the supply duct with the damper assembly or the inside of the supply duct is prevented from freezing.

16 Claims, 18 Drawing Sheets

(56) References Cited

U.S. PATENT DOCUMENTS

2022/0099352 A1* 3/2022 Lee ..... F25D 17/045

FOREIGN PATENT DOCUMENTS

| | | | | |
|---|---|---|---|---|
| KR | 10-1999-0009712 | | 2/1999 | |
| KR | 10-2001-0056077 | | 7/2001 | |
| KR | 100852484 | | 8/2008 | |
| KR | 100852484 | B1 * | 8/2008 | ..... F25D 17/045 |
| KR | 10-2020-0095887 | | 8/2020 | |
| KR | 2020-0095887 | A | 8/2020 | |
| KR | 10-2020-0107390 | | 9/2020 | |

OTHER PUBLICATIONS

KR-100852484-B1 Translation (Year: 2008).*
European Search Report dated Jul. 22, 2022 issued in EP Application No. 22158119.2.
Australian Examination Report dated Nov. 18, 2022 issued in Application 2022200266.
European Office Action dated Feb. 29, 2024, issued in Application No. 22158119.2.

* cited by examiner

REFRIGERATOR HAVING HEATER IN DUCT BETWEEN COMPARTMENTS

CROSS-REFERENCE TO RELATED APPLICATION

The present application claims priority to Korean Patent Application No. 10-2021-0028655, filed in Korea Mar. 4, 2021, the entire contents of which is incorporated herein for all purposes by this reference.

BACKGROUND

1. Field

The present disclosure relates to a refrigerator in which a supply duct configured to guide the flow of cold air from one storage compartment to another storage compartment and a damper for opening and closing the supply duct can be prevented from freezing.

2. Background

Generally, a refrigerator is a home appliance that is provided to store various foods for a long time with cold air generated by using the circulation of a refrigerant according to a refrigeration cycle.

In such a refrigerator, to freeze and store items to be stored, one storage compartment is provided, or a plurality of storage compartments are provided by being partitioned from each other. The storage compartment may include a freezer compartment for freezing and storing items to be stored, and a refrigerating compartment for refrigerating and storing the items, wherein the freezer compartment may include at least two freezer compartments or the refrigerating compartment may include at least two refrigerating compartments.

The freezer compartment and the refrigerating compartment may be configured to be partitioned vertically or horizontally with a partition wall placed therebetween. For example, in the case of a double door refrigerator, a freezer compartment at a first side and a refrigerating compartment at a second side are partitioned from each other with a partition wall placed therebetween.

In addition, the refrigerating compartment and the freezer compartment receive cold air generated by a refrigeration system and is controlled to maintain a temperature range between an upper limit reference temperature NT+Diff and a lower limit reference temperature NT-Diff relative to a preset reference temperature NT;Noth. For example, when a storage compartment has temperature higher than the upper limit reference temperature, a compressor is operated to supply cold air to the associated storage compartment, but when the storage compartment has temperature lower than the lower limit reference temperature, the operation of the compressor is stopped to cut off the cold air supplied into the associated storage compartment.

Particularly, in the case of a refrigerator that uses one evaporator to control the temperature of the refrigerating compartment and the freezer compartment, a cold air duct configured to guide the selective supply of at least some of cold air supplied to the freezer compartment (or the refrigerating compartment) to the refrigerating compartment (or the freezer compartment) is provided and is configured to be opened/closed by the damper.

That is, due to the opening or closing of the cold air duct by the damper, at least some of cold air passing through the evaporator can be supplied selectively to the freezer compartment or the refrigerating compartment.

Meanwhile, the damper exists in a storage compartment with high humidity and thus may freeze. Accordingly, in conventional technologies, various structures for preventing the freezing of the damper are provided.

For example, in a prior art disclosed in (Patent Document 1) Korean Patent Application Publication No. 10-1999-0009712, a heater is provided between two baffles, and when the closing of a refrigerator door is detected, the heater generates heat for a preset period of time to prevent the freezing of a damper.

However, in the prior art disclosed in (Patent Document 1), due to the heater, the damper and the surrounding area of the baffles are effectively prevented from freezing, but the freezing of a duct located at a side opposite to the damper still occurs.

Furthermore, in the prior art disclosed in (Patent Document 1), the heater is configured to operate only by opening and closing a refrigerator door, so when there is no opening or closing of the refrigerator door for a long time, there is a problem that the heater does not operate for a long time, which may cause freezing in the associated parts.

In addition, in a prior air disclosed in (Patent Document 2) Korean Patent Application Publication No. 10-2001-0056077, a cold air introduction hole is formed in a control box located inside a refrigerating compartment, so the space of the refrigerating compartment is reduced as much as the space of the associated control box. Particularly, in the case of the refrigerating compartment, when the heater generates heat, the surrounding temperature of the refrigerating compartment easily rises, which inevitably affects the refrigeration of the refrigerating compartment.

Accordingly, recently, a structure in which a damper is located in a freezer compartment and the installed portion of the damper and the refrigerating compartment are connected to each other by a flow duct so as to transfer cold air therebetween is provided. This is disclosed in (Patent Document 3) Korean Patent Application Publication No. 10-2020-0095887, and (Patent Document 4) Korean Patent Application Publication No. 10-2020-0107390.

In the prior arts disclosed in (Patent Document 3) and (Patent Document 4), the damper provided to maintain temperature difference generated between the refrigerating compartment and a refrigerating compartment duct is disposed in the freezer compartment, so the reduction of the space of the refrigerating compartment in the prior art disclosed in (Patent Document 2) is prevented.

However, in the prior arts disclosed in (Patent Document 3) and (Patent Document 4), freezing occurs in a connection portion between a damper housing (a first unit) provided to install the damper of a freezer compartment duct (a freezer grille assembly) and a supply duct (a second unit) connecting the damper housing with the refrigerating compartment duct (a refrigerating compartment grille assembly).

That is, the flow path of the supply duct is most preferably configured to completely correspond to the flow path of the damper housing, but in consideration that there may be a coupling error during assembly, normally, the inlet flow path of the supply duct is designed to be configured larger than the outlet flow path of the damper housing.

Accordingly, frost or dew generated during the discharge of cold air to the supply duct from the damper freezes in the flow path inlet of the supply duct (specifically, a stepped portion at the coupling portion of the supply duct with the damper housing).

Particularly, in the prior arts disclosed in (Patent Document 3) and (Patent Document 4) described above, even if ice is formed in the flow path inlet of the supply duct, it is difficult to remove the ice. Accordingly, as the frost frozen in the flow path inlet of the supply duct increases in size, flow resistance increases, and in the worst case, the associated flow path may be closed.

Of course, in the prior arts disclosed in (Patent Document 3) and (Patent Document 4), the ice may be defrosted by forcibly raising the temperature of the refrigerating compartment, or the ice may be defrosted by periodically (or intermittently) performing operation control for defrosting in the supply duct.

However, defrost water generated during the defrosting flows down on the wall surface of the inside of the supply duct, and flows down to the connection portion of the supply duct with the damper housing, and collects in a portion at which the damper is located. Accordingly, there is an additional problem that the defrost water freezes during the operation of the refrigerator and causes the malfunction of the damper.

DOCUMENTS OF RELATED ART (Patent Document 1) Korean Patent Application Publication No. 10-1999-0009712

(Patent Document 2) Korean Patent Application Publication No. 10-2001-0056077

(Patent Document 3) Korean Patent Application Publication No. 10-2020-0095887

(Patent Document 4) Korean Patent Application Publication No. 10-2020-0107390

BRIEF DESCRIPTION OF THE DRAWINGS

Embodiments will be described in detail with reference to the following drawings in which like reference numerals refer to like elements, and wherein.

DETAILED DESCRIPTION

Hereinafter, the exemplary embodiment of the refrigerator of the present disclosure will be described with reference to FIGS. 1 to 20.

Figure 1:
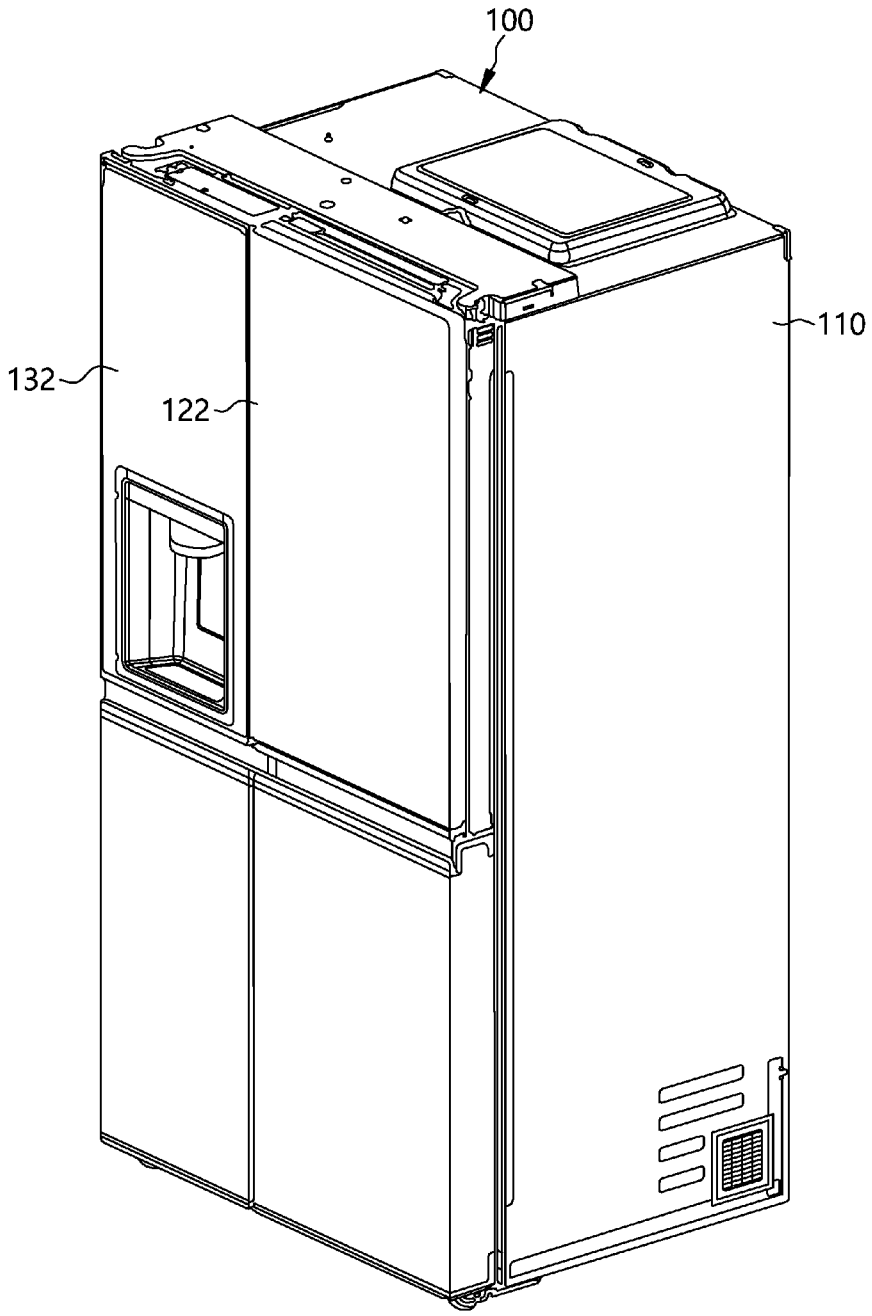
FIG. 1 is a perspective view of the exterior of a refrigerator according to an embodiment of the present disclosure.
Figure 2:
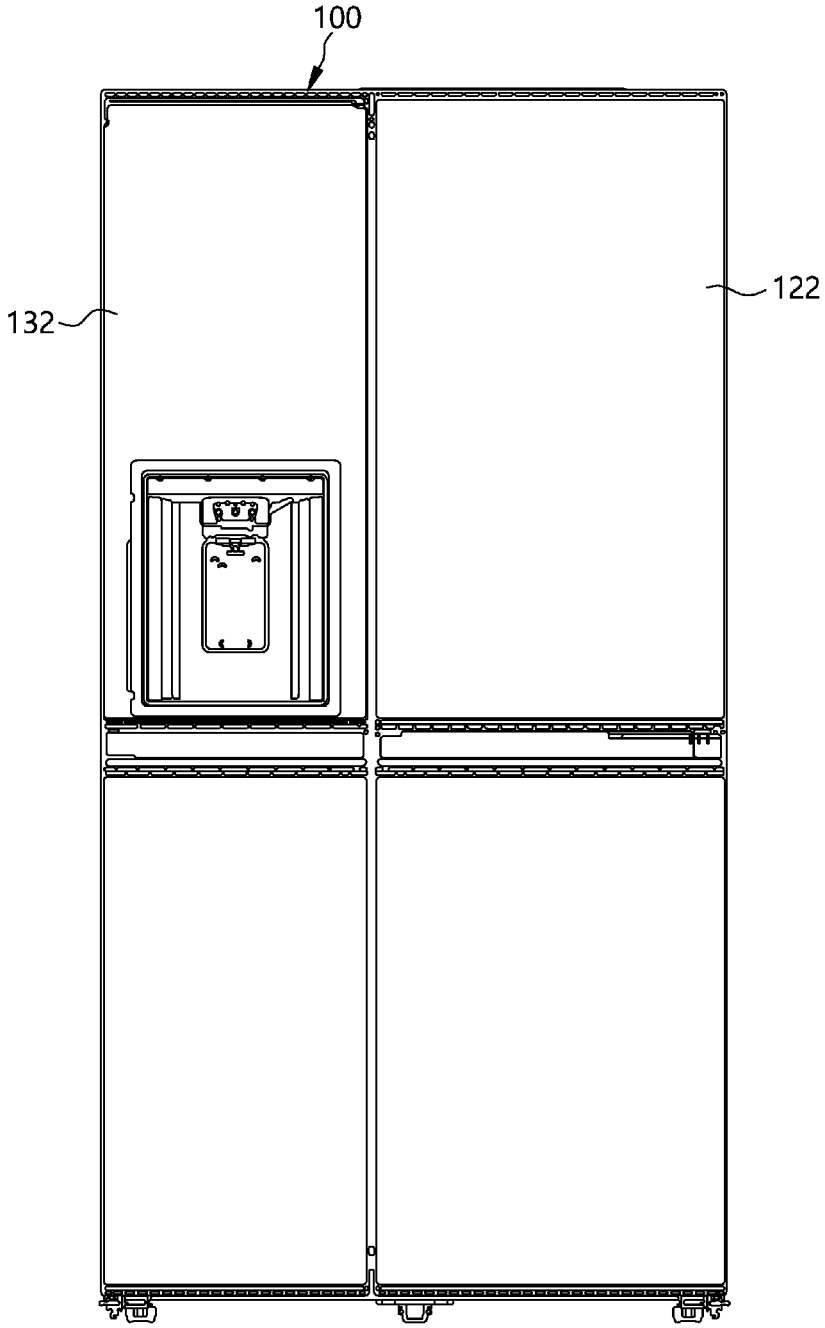
FIG. 2 is a front view illustrating the state of the exterior of the refrigerator according to the embodiment of the present disclosure.
Figure 3:
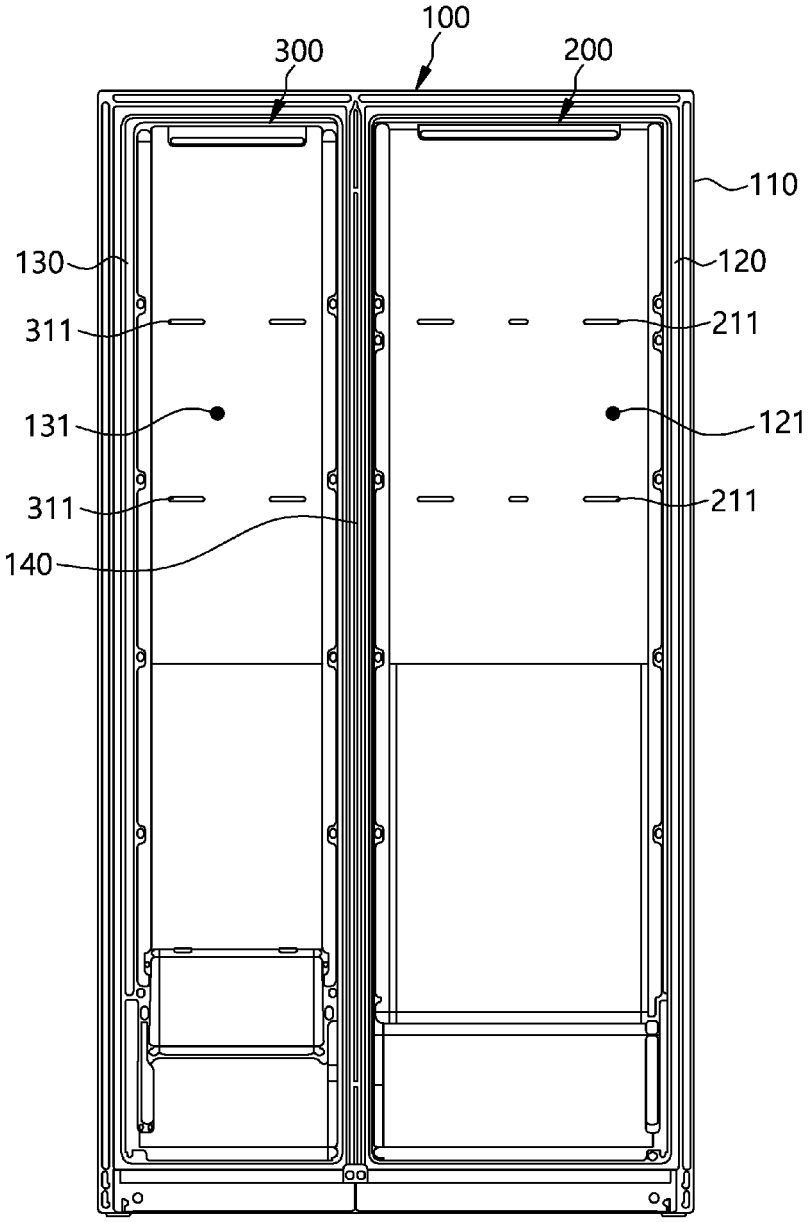
FIG. 3 is a front view illustrating the state of the inside of the refrigerator according to the embodiment of the present disclosure.

FIGS. 1 and 2 illustrate the exterior structure of the refrigerator according to the embodiment of the present disclosure, and FIG. 3 illustrates the internal structure of the refrigerator according to the embodiment of the present disclosure.

Figure 4:
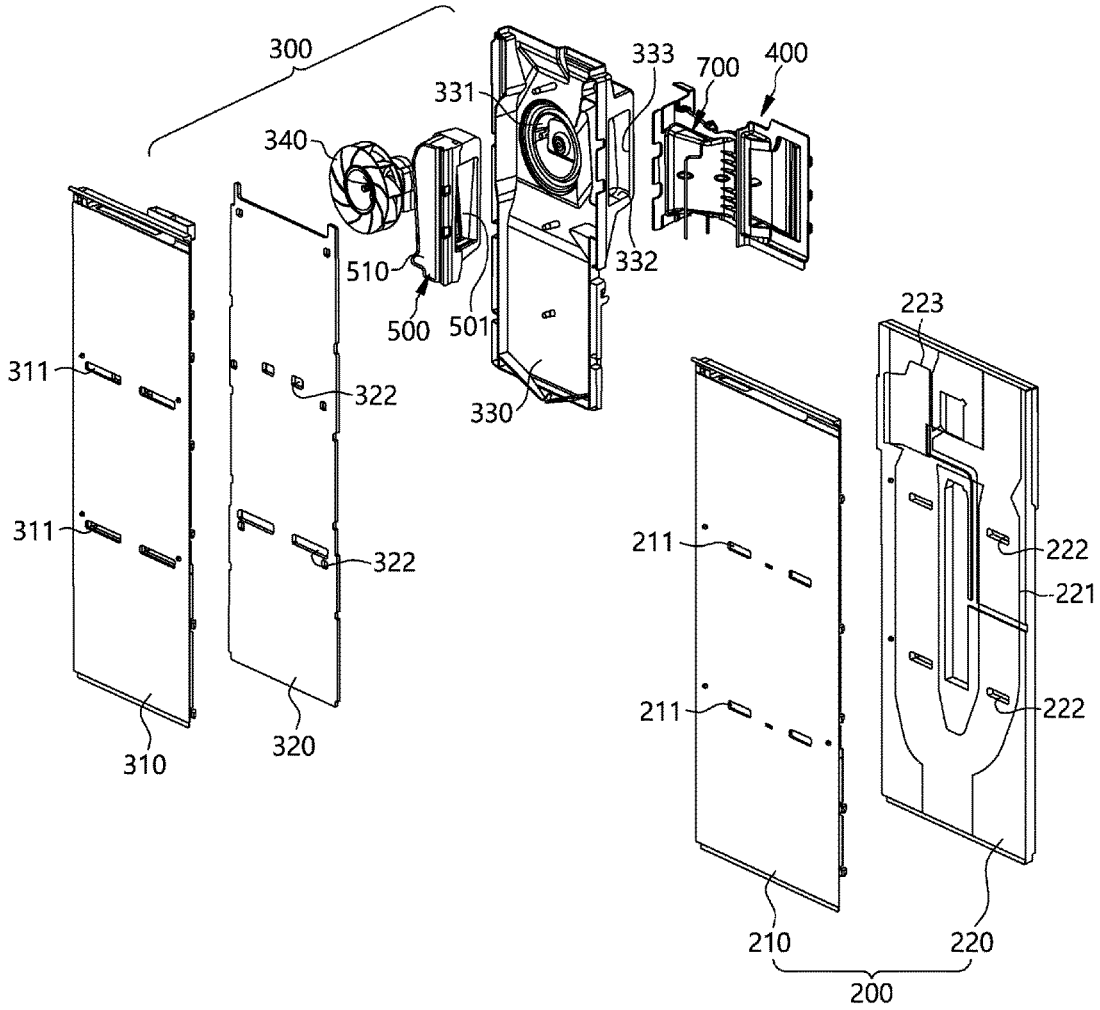
FIG. 4 is a view illustrating the structure and combined relation of each grille assembly, a damper assembly, and a supply duct of the refrigerator according to the embodiment of the present disclosure.
Figure 5:
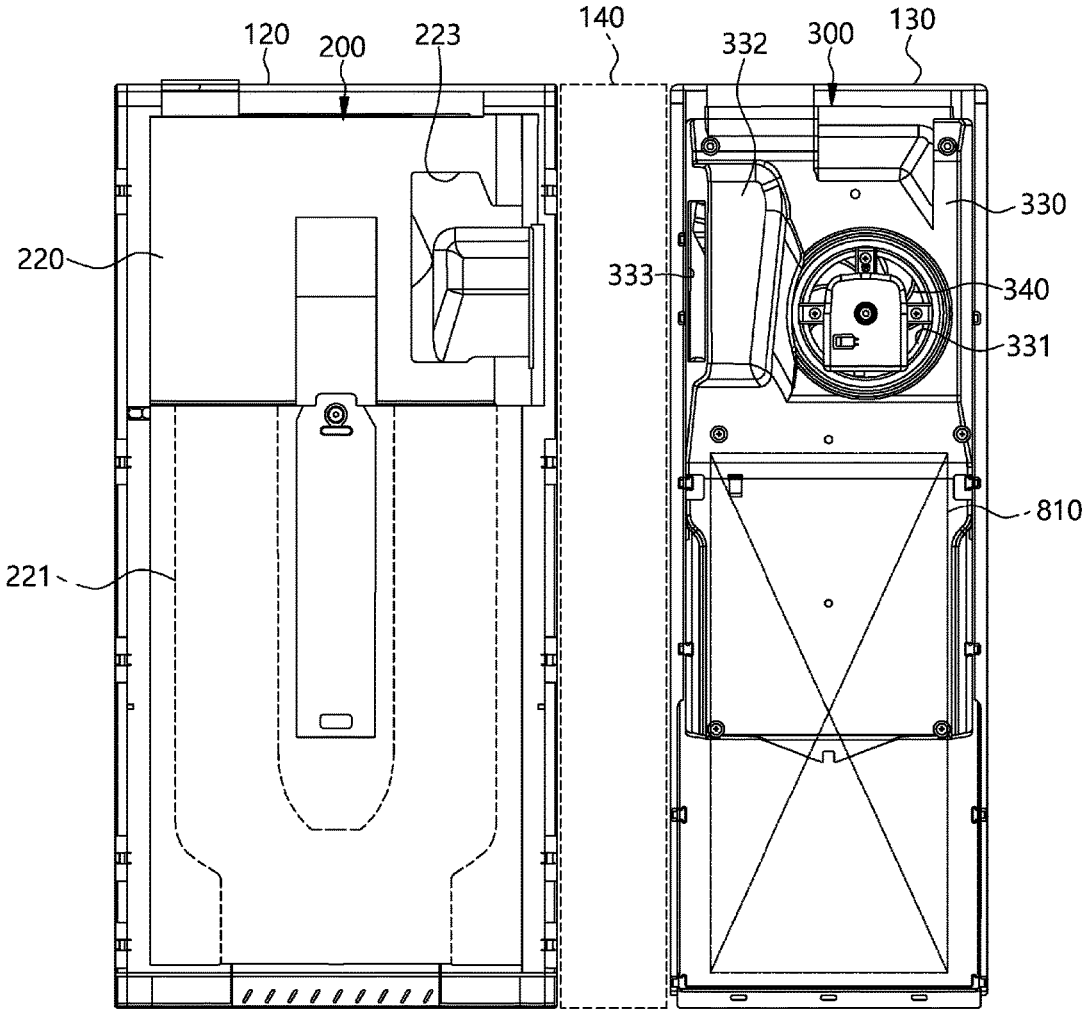
FIG. 5 is a rear view of each of the grille assemblies of the refrigerator according to the embodiment of the present disclosure.
Figure 6:
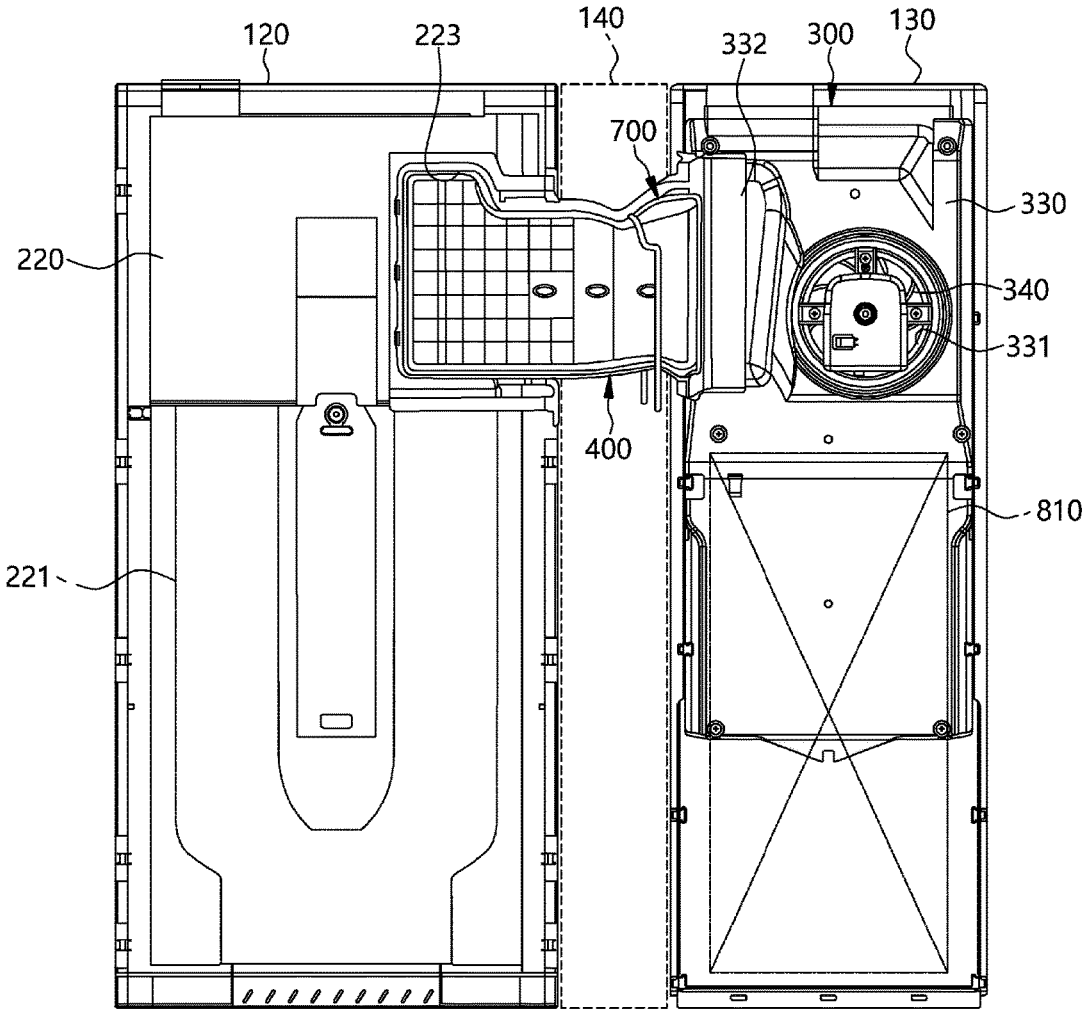
FIG. 6 is a view illustrating a state in which the supply duct is mounted to each of the grille assemblies of the refrigerator according to the embodiment of the present disclosure.
Figure 7:
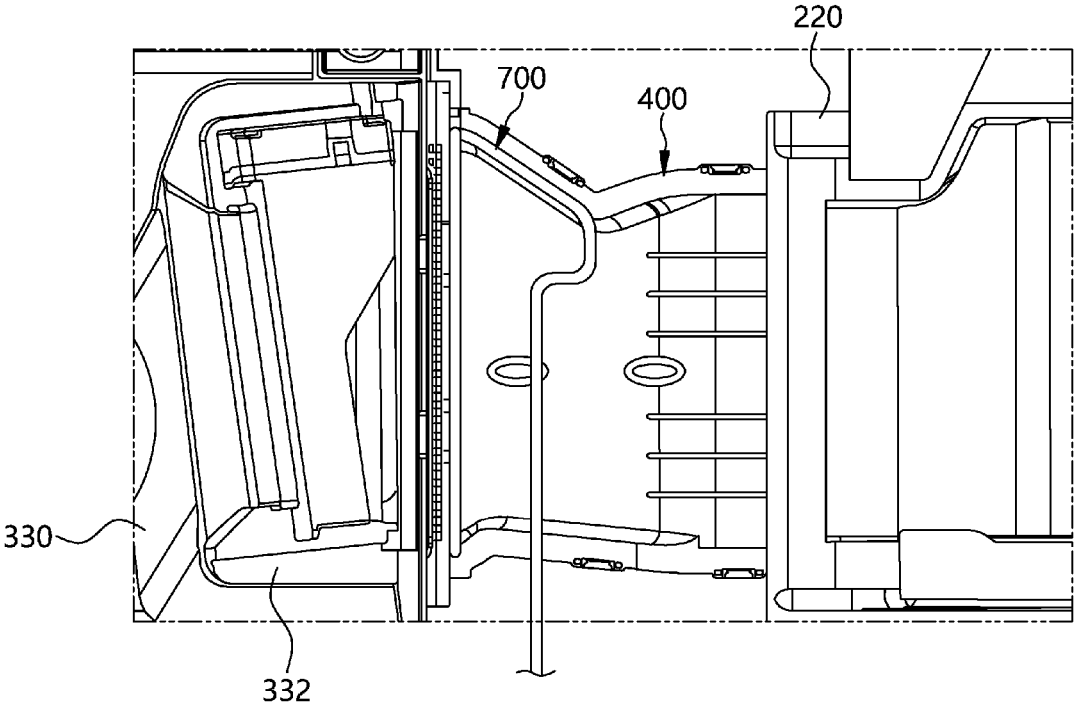
FIG. 7 is a view illustrating the structures of the supply duct and a second heater mounted to the supply duct in the refrigerator according to the embodiment of the present disclosure.

In addition, FIG. 4 is a view illustrating the assembly structure of each grille assembly, a damper assembly, and a supply duct of the refrigerator according to the embodiment of the present disclosure.

As illustrated in these drawings, in the refrigerator according to the embodiment of the present disclosure, a first heater 600 may be provided in the damper assembly 500, and a second heater 700 may be provided in the supply duct 400.

That is, due to the first heater 600, the damper assembly 500 or the connection portion of the damper assembly 500 with the supply duct 400 may be prevented from freezing, and due to the second heater 700, the connection portion of the supply duct 400 with the damper assembly 500 or the inside of the supply duct 400 may be prevented from freezing. Accordingly, due to the provision of the first heater 600 and the second heater 700, the damper assembly 500 may be provided in a second grille assembly 300, and the damper assembly 500 and the supply duct 400 may be prevented from freezing.

Hereinafter, each component of such a refrigerator according to the embodiment of the present disclosure will be described more in detail.

First, the refrigerator according to the embodiment of the present disclosure may include a refrigerator body 100.

As illustrated in FIG. 3, the refrigerator body 100 may include an outer casing 110 constituting the outer body of the refrigerator body 100 and inner casings 120 and 130 located in the outer casing 110.

Here, the inner casings 120 and 130 may include a plurality of inner casings, wherein the inner casings may be configured to form storage compartments 121 and 131, respectively. That is, the inner casings 120 and 130 may be configured as box bodies open forward and may have the storage compartments 121 and 131 formed respectively therein so as to store items therein.

Such a refrigerator body 100 may be configured to have a first storage compartment 121 at a first side of a partition wall 140 and to have a second storage compartment 131 at a second side thereof, between the partition wall 140 placed between the first storage compartment 121 and the second storage compartment 131. That is, a first inner casing 120 which provides the first storage compartment 121 and a second inner casing 130 which provides the second storage compartment 131 may be provided at the first and second sides, respectively, with the partition wall 140 placed between the first inner casing 120 and the second inner casing 130.

The two inner casings 120 and 130 may be provided respectively at the left and right sides of the refrigerator body 100, and may be provided respectively at the upper and lower sides of the refrigerator body 100. In the embodiment of the present disclosure, when the refrigerator body 100 is viewed from the front side, the first storage compartment 121 of the first inner casing 120 is located at the right side, and the second storage compartment 131 of the second inner casing 130 is located at the left side.

Furthermore, the second storage compartment 131 may maintain temperature lower than the temperature of the first storage compartment 121. For example, the second storage compartment 131 may be a freezer compartment maintained at temperature below 0° C., and the first storage compartment 121 may be a refrigerating compartment maintained at temperature greater than 0° C.

In addition, doors 122 and 132 may be located on the open front surfaces of the inner casings 120 and 130, respectively, and may selectively open and close the storage compartments 121 and 131, respectively. In this case, each of the doors 122 and 132 may be a swinging door or drawer-type door.

Next, the refrigerator according to the embodiment of the present disclosure may include a first grille assembly 200.

The first grille assembly 200 may be located at the rear of the inside of the first inner casing 120, and may function to guide the flow of cold air supplied into the first storage compartment 121.

As illustrated in FIG. 4, the first grille assembly 200 may include a first grille panel 210 located to be exposed to the inside of the first storage compartment 121 and a first duct plate 220 coupled to the rear of the first grille panel 210.

Here, a plurality of first cold air discharge holes 211 may be formed in the first grille panel 210 so as to discharge cold air to the first storage compartment 121, and a cold air flow path 221 may be formed in the first duct plate 220 so as to supply cold air to each of the first cold air discharge holes 211.

Furthermore, a plurality of first communication holes 222 corresponding to the first cold air discharge holes 211, respectively, may be formed in the first duct plate 220, and the cold air flow path 221 may be configured to pass each of the first communication holes 222. In this case, the cold air flow path 221 may be formed concavely on the rear surface of the first duct plate 220 or may be formed in the first duct plate 220.

In addition, a supply hole 223 through which cold air is supplied from the supply duct 400 may be formed in a side of the rear surface of the first duct plate 220, and the cold air flow path 221 may be configured to communicate with the supply hole 223.

That is, after cold air transferred to the supply duct 400 is introduced through the supply hole 223 to the cold air flow path 221, the cold air may flow along the cold air flow path 221 and may flow sequentially through each of the first communication holes 222 and each of the first cold air discharge holes 211, and may be supplied into the first storage compartment 121.

Next, the refrigerator according to the embodiment of the present disclosure may include the second grille assembly 300.

The second grille assembly 300 may be located at the rear of the inside of the second inner casing 130, and may function to guide the flow of cold air supplied into the second storage compartment 131.

As illustrated in FIG. 4, the second grille assembly 300 may include: a second grille panel 310 located to be exposed to the inside of the second storage compartment 131, a second duct plate 320 coupled to the rear of the second grille panel 310, a shroud 330 coupled to the rear of the second duct plate 320, and a blower fan 340 installed between the second duct plate 320 and the shroud 330.

Here, a plurality of second cold discharge holes 311 may be formed in the second grille panel 310 so as to discharge cold air to the second storage compartment 131, and the cold air flow path (not shown) may be formed in the second duct plate 320 so as to supply cold air to each of the second cold discharge holes 311.

Furthermore, a plurality of second communication holes 322 corresponding to the second cold discharge holes 311, respectively, may be formed in the second duct plate 320, and the cold air flow path may be configured to pass each of the second communication holes 322. In this case, the cold air flow path may be configured to be recessed from the rear surface of the second duct plate 320 or may be configured in the second duct plate 320.

In addition, a cold air introduction hole 331 through which cold air passing through an evaporator 810 is introduced may be formed in the shroud 330.

In addition, a mounting part 332 for the mounting of the damper assembly 500 may be configured at a side of the shroud 330 facing the first grille assembly 200. In this case, the mounting part 332 may be formed concavely from the front surface of the shroud 330 (a surface opposite to the second duct plate) to receive the damper assembly 500.

Furthermore, in the side wall surfaces of the shroud 330, an exposure hole 333 may be formed in the side wall surface of the shroud 330 in which the mounting part 332 is formed, wherein a passing flow path 501 of the damper assembly 500 installed in the mounting part 332 may be exposed to the shroud 330.

Next, the refrigerator according to the embodiment of the present disclosure may include the supply duct 400.

The supply duct 400 may function to supply some of cold air guided by the second grille assembly 300 to the first grille assembly 200.

The supply duct 400 may be configured as a duct having a supply flow path 401 (see FIGS. 8 to 12) formed therein. In this case, the first end of the supply duct 400 may be connected to the first grille assembly 200, and the second end of the supply duct 400 may be connected to the second grille assembly 300.

Specifically, the first end of the supply duct 400 may be configured to cover the supply hole 223 formed in the rear surface of the first grille assembly 200, and an outlet 411 (see FIGS. 13 to 15) through which cold air is supplied to the supply hole 223 may be formed in a portion of the supply duct 400 corresponding to the supply hole 223. In this case, the outlet 411 may be the cold air discharge portion of the supply flow path 401.

In addition, the second end of the supply duct 400 may be configured to cover the exposure hole 333 formed in the side surface of the second grille assembly 300, and an inlet 412 (see FIG. 14) through which cold air is supplied from the exposure hole 333 may be formed in a portion of the supply duct 400 corresponding to the exposure hole 333. In this case, the inlet 412 may be the cold air introduction portion of the supply flow path 401.

In addition, the supply duct 400 may be configured as a duct formed with a single member, or may be configured as a duct formed by coupling at least two members to each other.

The supply duct 400 according to the embodiment of the present disclosure, for an example, may be formed by coupling a body part 410 to a cover part 420.

Here, the body part 410 may be a part which is located at a side facing each of the two grille assemblies 200 and 300 and has an outer surface formed to be open, and the cover part 420 may be a part configured to cover the open outer surface of the body part 410.

Particularly, the inlet 412 of the supply duct 400 may be formed by coupling the body part 410 to the cover part 420, and the outlet 411 of the supply duct 400 may be formed in the body part 410.

Meanwhile, each portion of the inside of the supply duct 400 may have different temperature. For example, the connection portion of the supply duct 400 with the second grille assembly 300 may have temperature lower than the temperature of the connection portion of the supply duct 400 with the first grille assembly 200.

In consideration this, in the connection portion of the inner surface of the supply duct 400 with the second grille assembly 300, condensate water is more likely to be generated due to temperature difference between the inside and outside of the supply duct 400, and this generated condensate water may flow down along the wall surface of the associated supply duct 400 and may collect and freeze in the lower portion of the inside of the supply duct 400.

Accordingly, in the embodiment of the present disclosure, a guide rib 430 (see FIGS. 8 and 14) may be formed on the inner surface of the supply duct 400 such that condensate water flowing down from the upper surface of the inside of the supply duct 400 flows to the first grille assembly 200 connected to the first end of the supply duct 400.

That is, the condensate water flowing down along the inner wall surface of the supply duct 400 may not collect in the connection portion of the supply duct 400 with the second grille assembly 300, but may flow down to the first storage compartment 121 which has temperature above zero, so the condensate water may be prevented from freezing.

The guide rib 430 may be formed from the inlet 412 to the outlet 411 in the inner surface of the supply duct 400 such that the guide rib 430 is formed to be inclined or rounded downward gradually toward the outlet 411 from the inlet 412.

Particularly, the guide rib 430 is preferably configured to have a protruding height of 1.5 mm to 2.5 mm. That is, when the guide rib 430 protrudes to have the height of less than 1.5 mm, condensate water may directly flow down without being guided by the guide rib, and when the guide rib 430 protrudes to have height higher than 2.5 mm, the resistance of cold air flow in the supply flow path 401 may increase.

Next, the refrigerator according to the embodiment of the present disclosure may include the damper assembly 500.

The damper assembly 500 may function to selectively perform or stop the supply of cold air toward the supply duct 400 from the second grille assembly 300.

For example, during the cooling operation of the first storage compartment 121, the damper assembly 500 may open the supply duct 400 such that cold air introduced into the second grille assembly 300 is supplied to the first storage compartment 121. During the cooling operation of the second storage compartment 131, the damper assembly 500 may close the supply duct 400 such that cold air introduced into the second grille assembly 300 is supplied to the second storage compartment 131.

Figure 8:
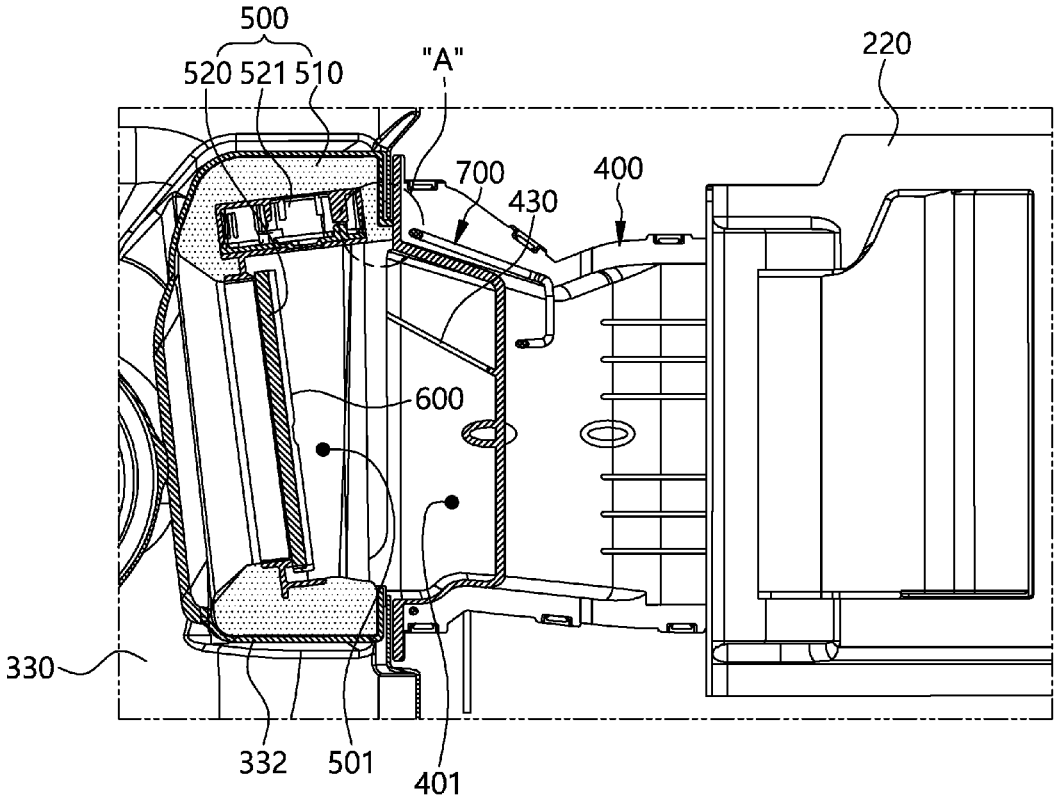
FIG. 8 is a sectional view illustrating the structures of the supply duct and the second heater mounted to the supply duct in the refrigerator according to the embodiment of the present disclosure.

As illustrated in FIG. 8, such a damper assembly 500 may include a damper cover 510 and a damper 520.

The damper cover 510 may be a part mounted to the connection portion of the second grille assembly 300 with the supply duct 400.

The damper cover 510 may be formed of an insulating material (for example, Styrofoam).

Furthermore, the damper cover 510 may be configured to have an inlet through which cold air is introduced and an outlet through which cold air is discharged, and may have the passing flow path 501 formed therein, the passing flow path communicating the inlet with the outlet. In this case, the inlet of the damper cover 510 may communicate with a part at which the blower fan 340 of the second grille assembly 300 is located, and the outlet of the damper cover 510 may communicate with the inlet 412 of the supply duct 400.

In addition, the damper 520 may be installed in the passing flow path 501 of the damper cover 510. The damper 520 may be coupled to a damper motor 521 and may be configured to open/close the passing flow path 501 by being rotated due to the operation of the damper motor 521.

Meanwhile, the passing flow path 501 of the damper assembly 500 is most preferably configured to correspond to the supply flow path 401 of the supply duct 400 for cold air flow and freezing prevention.

However, when tightly coupling two normal components to each other, due to an assembly tolerance between the two components, the two components may not exactly match each other and a step may occur therebetween.

That is, during the coupling of the supply duct 400 to the wall surface of the second grille assembly 300 in which the exposure hole 333 is formed, due to an assembly tolerance therebetween, the supply flow path 401 of the supply duct 400 and the passing flow path 501 of the damper assembly 500 in the exposure hole 333 may not match exactly with each other, but may be partially misaligned from each other.

Figure 9:
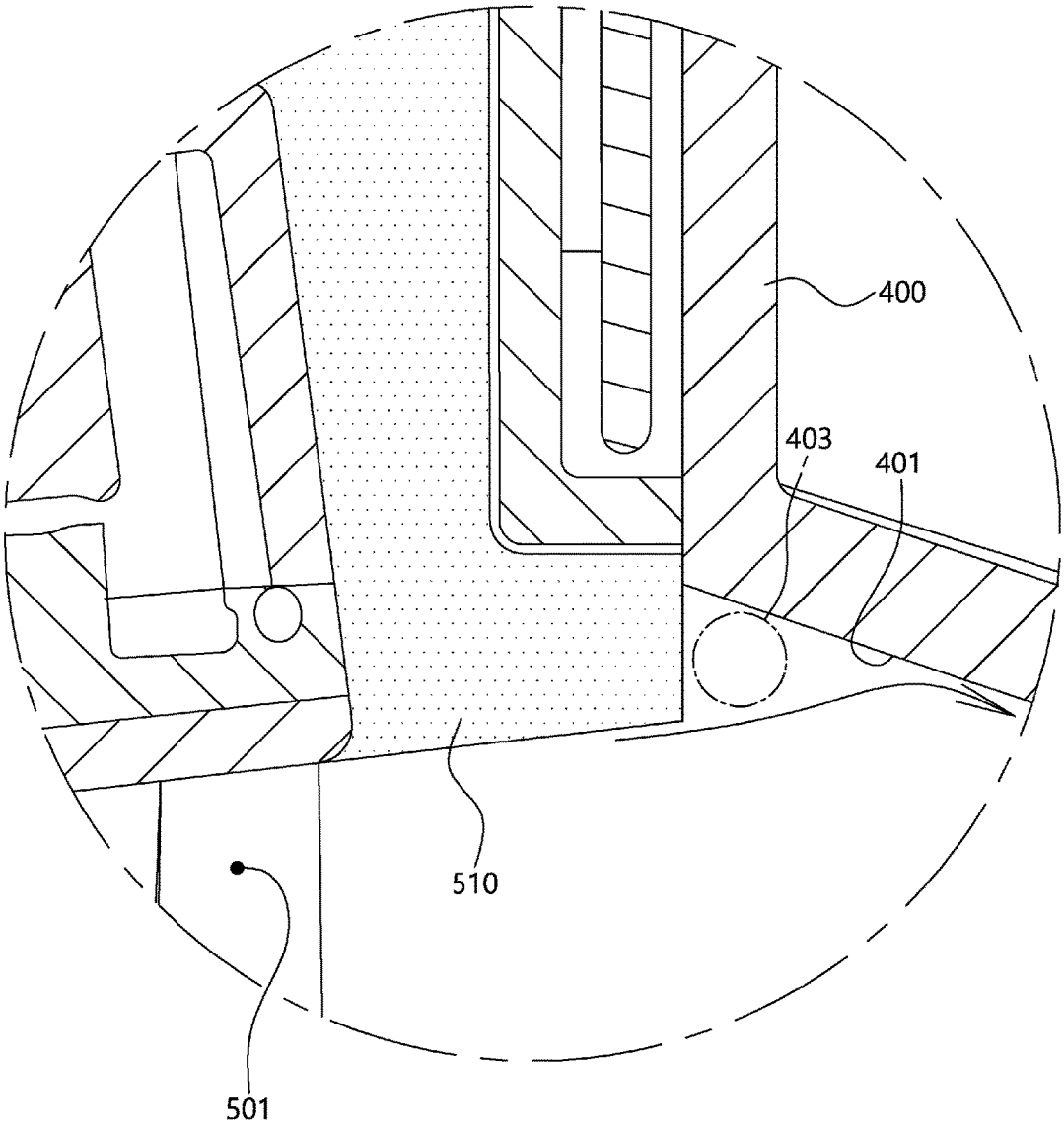
FIG. 9 is an enlarged view illustrating the states of a second grille assembly and the supply duct when a step occurs therebetween.
Figure 10:
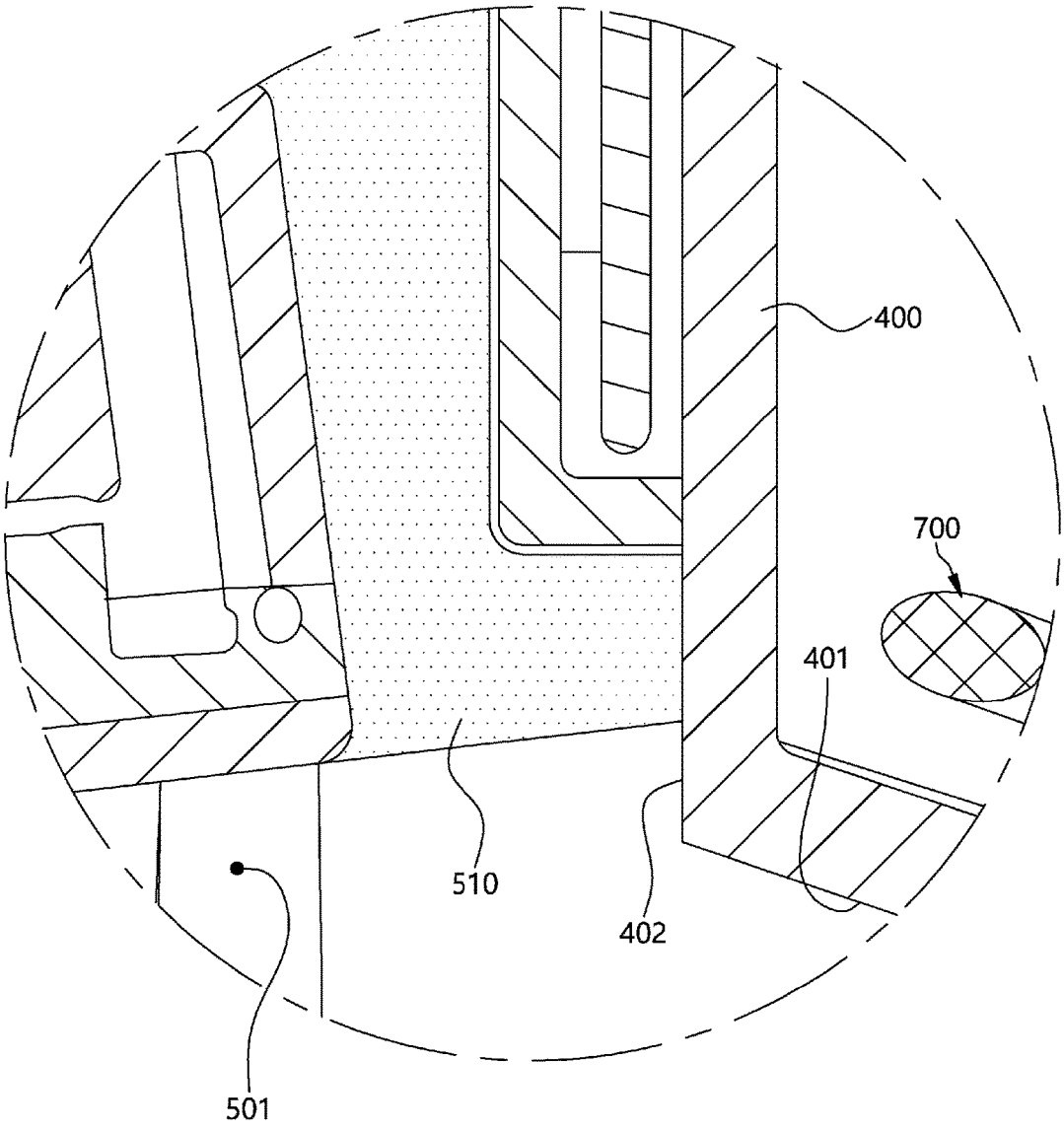
FIG. 10 is an enlarged view of an "A" part of FIG. 8 illustrating a reverse step structure between the second grille assembly and the supply duct.
Figure 11:
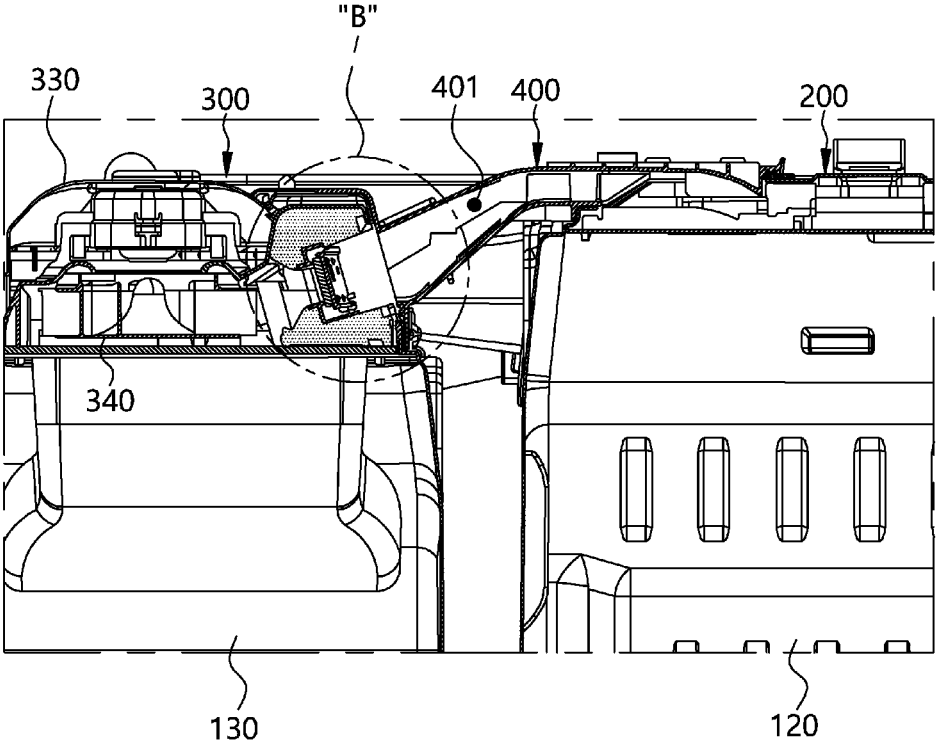
FIG. 11 is a planar sectional view illustrating the installed state of the supply duct of the refrigerator according to the embodiment of the present disclosure.

However, when the supply duct 400 is assembled with the passing flow path 501 by being misaligned upward therefrom, a step may be formed between the outer surface of the damper cover 510 of the damper assembly 500 and the upper surface of the inlet of the supply flow path 401, and condensate water may be frozen in the portion 403 of such a step (see FIG. 9). That is, cold air may not flow to the step portion 403, so even if dew is formed in the associated portion, this dew may not be removed.

In consideration of this, in the embodiment of the present disclosure, a step 402 (see FIG. 10) (hereinafter, referred to as "a reverse step") with which some of flowing cold air hits is formed in the communication portion of the inlet 412 of the supply flow path 401 with the outlet of the passing flow path 501.

That is, a normal step is generally formed so as not to interfere with the flow of cold air, but as described above, as for such a normal step, condensate water may be frozen in the associated step portion 403. Accordingly, the reverse step 402 may be formed by protruding a portion of the supply duct 400 to the inside of the passing flow path 501 such that the freezing of the condensate water can be prevented.

In this case, the reverse step 402 may be continuously hit by cold air, and the cold air may be dry air in which moisture is removed from the cold air while the cold air passes through the evaporator, so even if condensate water is generated in the associated portion, the cold air may directly hit condensate water and may remove the moisture thereof so as to prevent freezing.

Of course, due to the reverse step 402 described above, the flow of cold air introduced into the supply flow path 401 through the passing flow path 501 may be partially interrupted. However, when it is considered that a problem caused by freezing is more serious than the interruption of the cold air flow described above and power consumption required to prevent such freezing is great, even if the loss of cold air flow occurs, preventing the freezing is more preferable.

Particularly, the reverse step 402 described above may be configured to be larger than an assembly tolerance, so in the process of assembling the damper assembly 500 or the supply duct 400 with the second grille assembly 300, even if some misalignment from each other occurs due to the assembly tolerance therebetween, the reverse step 402 may exist in the inlet 412 of the supply flow path 401.

Furthermore, the reverse step 402 is preferably configured to have height formed to be within 5 mm. That is, when the height of the reverse step 402 exceeds 5 mm, the loss of cold air flow may increase rapidly, and flow noise may be loud, but when the reverse step 402 is configured to have height which is within 5 mm, freezing may be sufficiently prevented.

In addition, the reverse step 402 may be formed in the entire portion of the outlet of the passing flow path 501, or only in a portion of the outlet of the passing flow path 501.

However, when it is considered that condensate water does not flow down but collects in the upper portion of each of the outlet of the passing flow path 501 and the inlet 412 of the supply flow path 401 than other portions thereof, the upper portion of the inlet 412 of the supply flow path 401 may be most preferably configured to be located at a position lower than the upper portion of the outlet of the passing flow path 501.

The reverse step 402 may be formed by a size difference between the two flow paths 401 and 501, or may be formed by the partial misalignment of assembly positions thereof.

That is, the inlet 412 of the supply flow path 401 may be configured to be smaller than the outlet of the passing flow path 501, or the upper portion of the inlet 412 of the supply flow path 401 may be configured to be located at a position lower than the upper portion of the outlet of the passing flow path 501.

Next, the refrigerator according to the embodiment of the present disclosure may include the first heater 600.

The first heater 600 may be a heater provided to prevent the freezing of the damper assembly 500 or the freezing of the connection portion of the damper assembly 500 with the supply duct 400.

Figure 12:
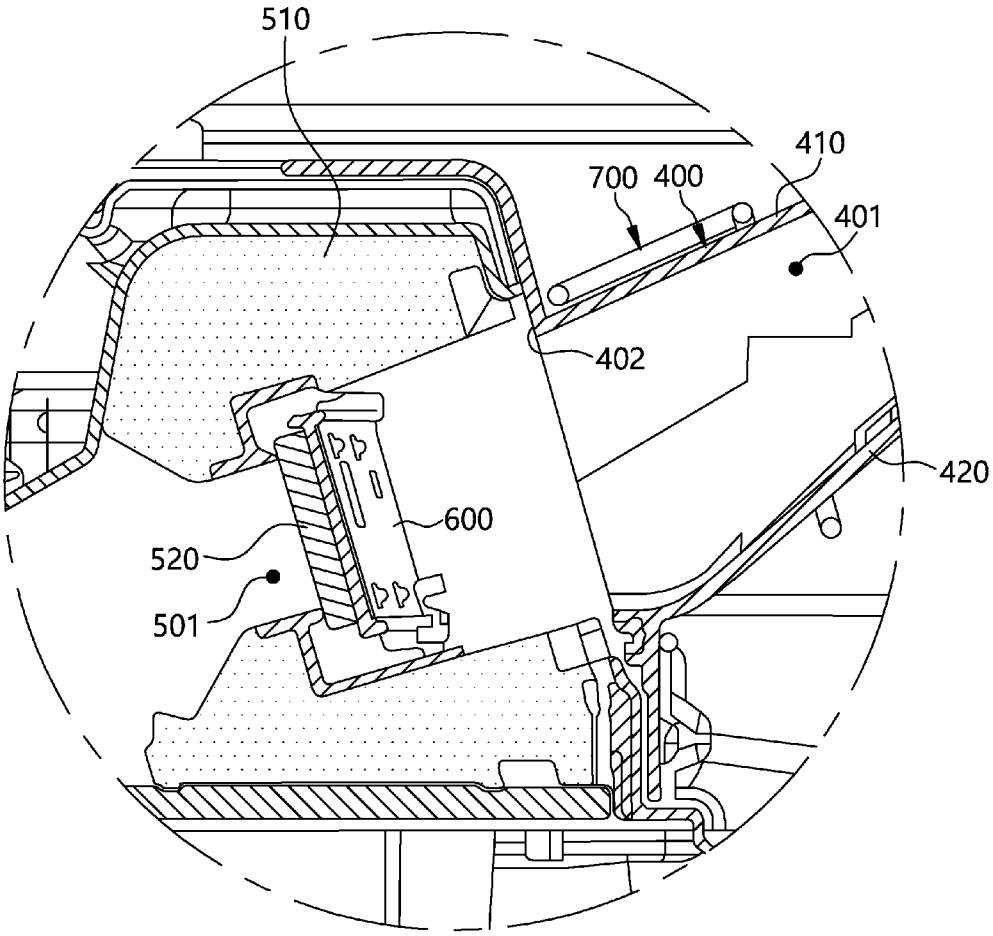
FIG. 12 is an enlarged view of a "B" part of FIG. 11.
Figure 13:
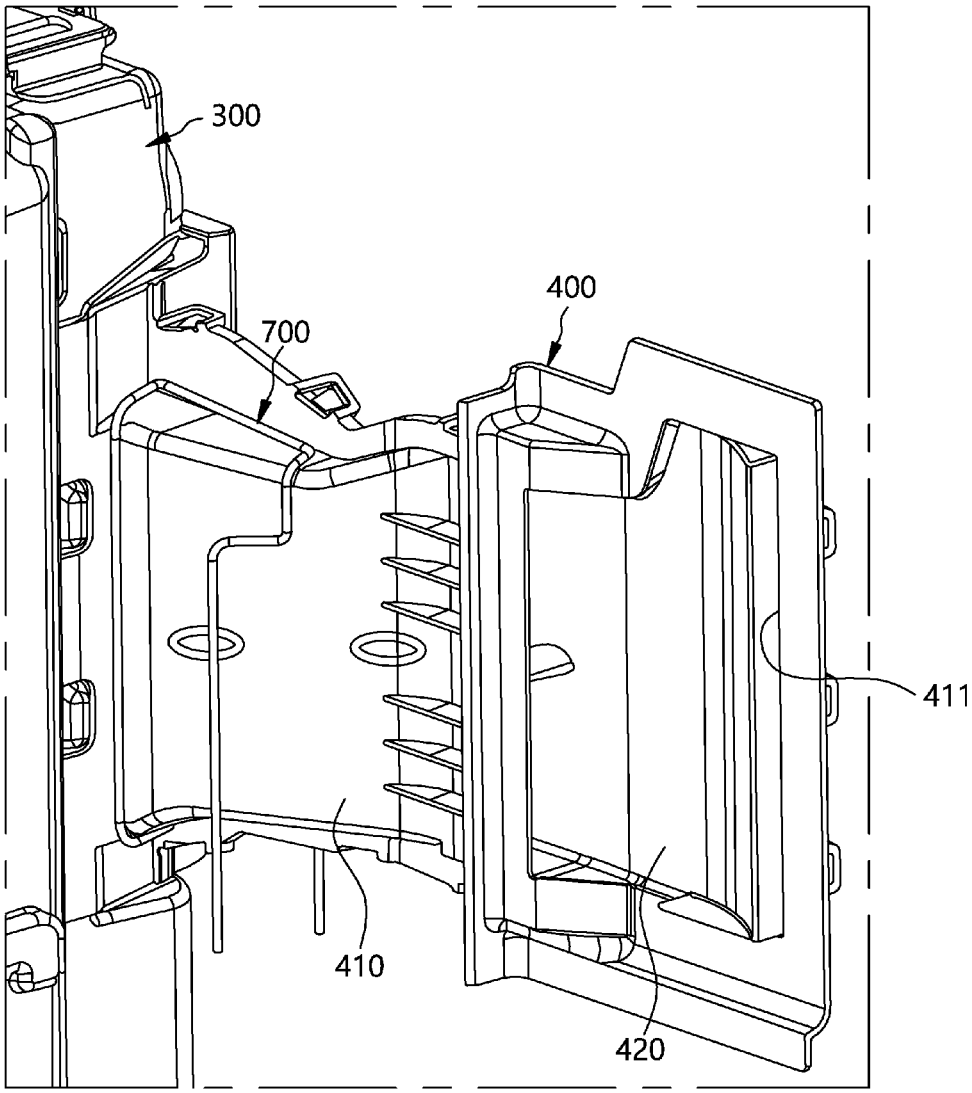
FIG. 13 is a perspective view illustrating the installed state of the supply duct of the refrigerator according to the embodiment of the present disclosure.
Figure 14:
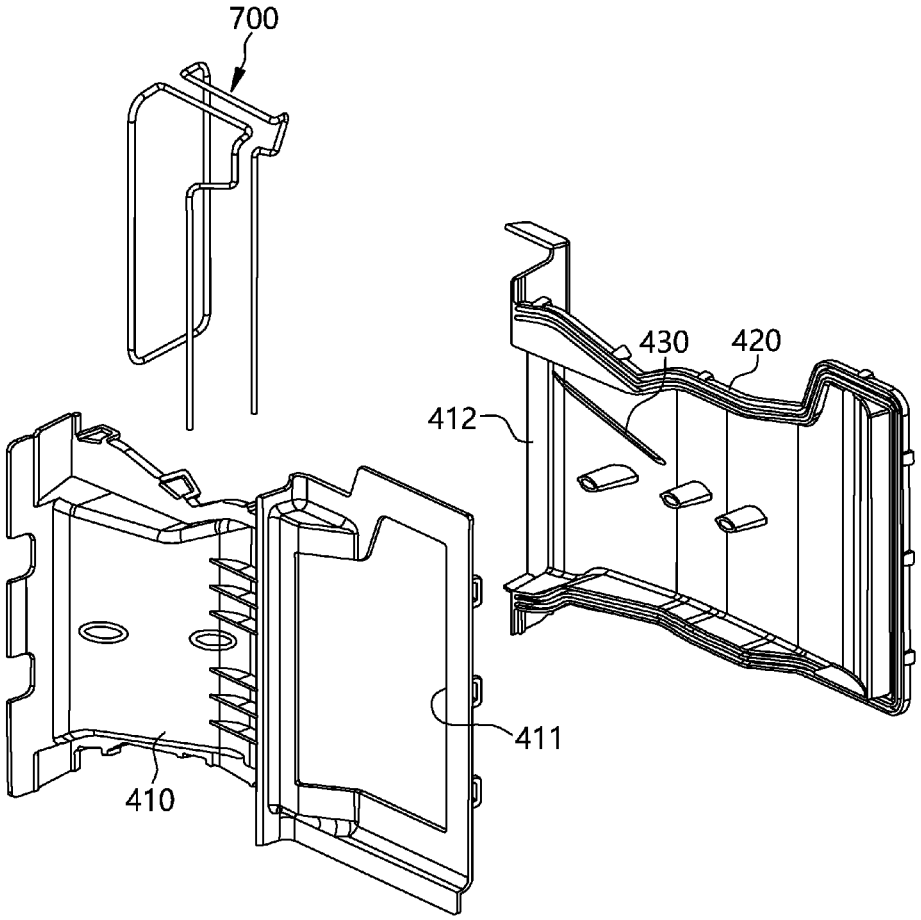
FIG. 14 is an exploded perspective view of the supply duct of the refrigerator according to the embodiment of the present disclosure viewed from the front of the supply duct.
Figure 15:
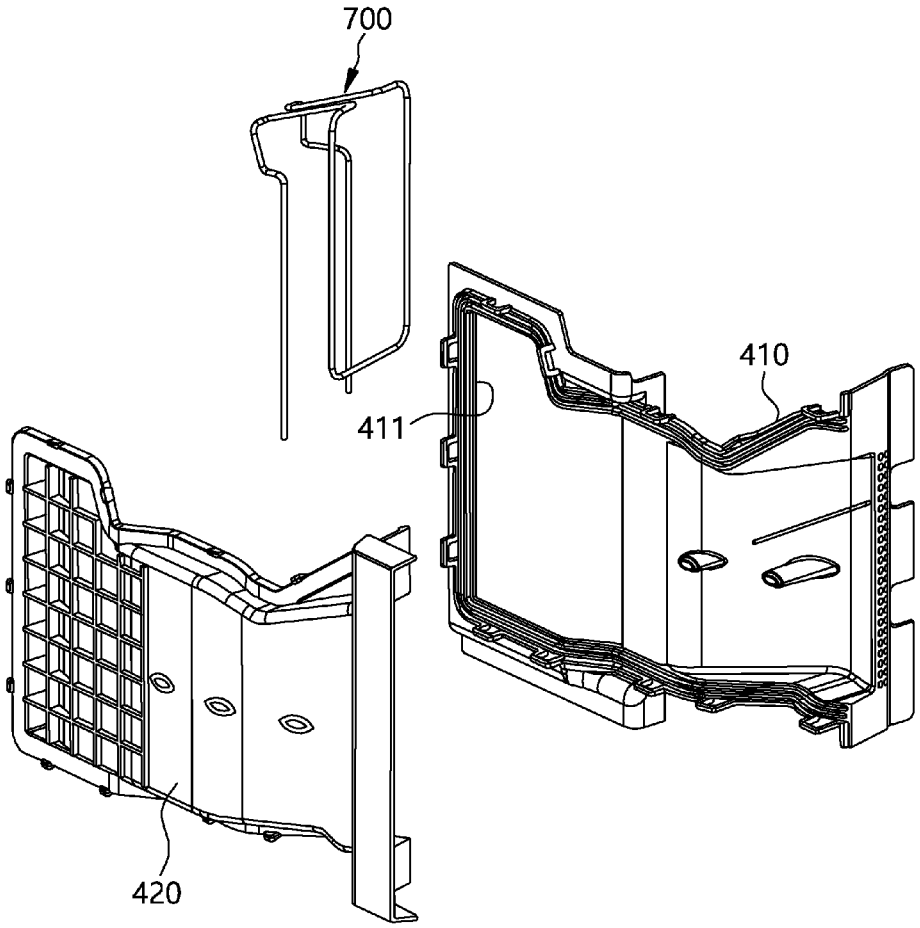
FIG. 15 is an exploded perspective view of the supply duct of the refrigerator according to the embodiment of the present disclosure viewed from the rear of the supply duct.
Figure 16:
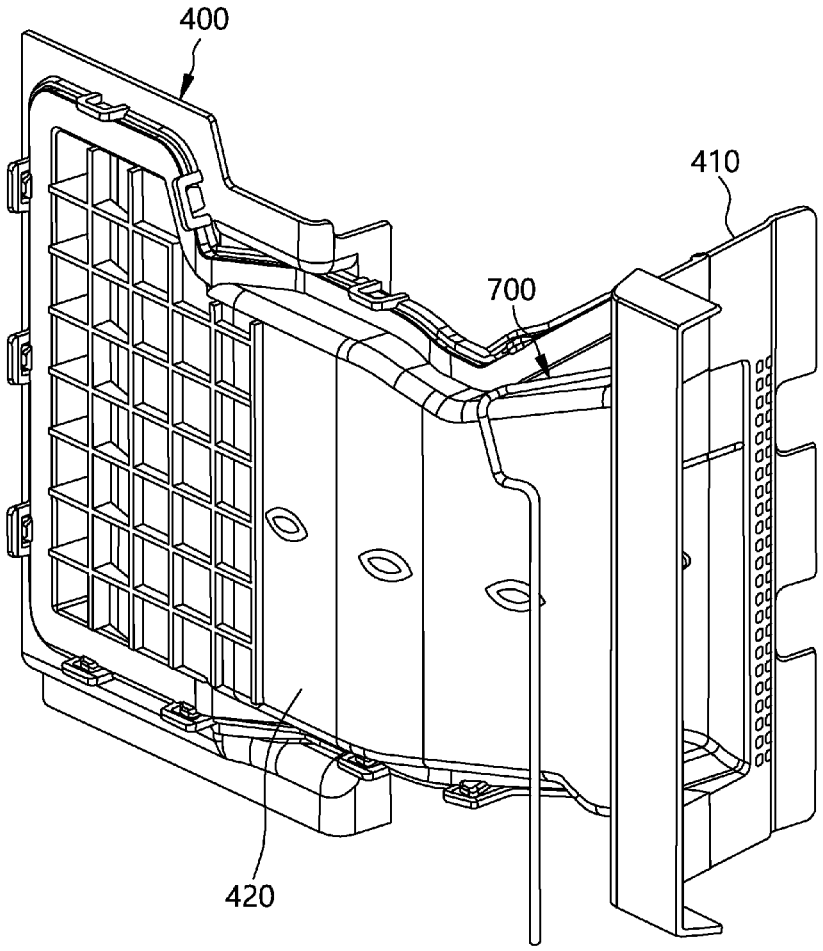
FIG. 16 is a combined perspective view of the supply duct of the refrigerator according to the embodiment of the present disclosure viewed from the rear of the supply duct.

As illustrated in FIGS. 8 and 12, such a first heater 600 may be provided in the damper assembly 500. Specifically, the first heater 600 may be provided on the outer surface of the damper 520.

Particularly, the first heater 600 may be located on a surface of the outer surfaces of the damper 520 directed to the supply duct 400 during the closing of the passing flow path 501. Accordingly, the freezing of the damper 520 may be prevented, and the freezing of the supply flow path 401 formed inside the supply duct 400 may also be prevented due to heat generated by the heating of the first heater 600.

The first heater 600 may be configured as a surface heating body. Accordingly, it is possible to install the first heater 600 on the surface of the damper 520, and it is possible to evenly heat the entire portion of the damper 520.

Next, the refrigerator according to the embodiment of the present disclosure may include the second heater 700.

The second heater 700 is a heater provided to prevent the freezing of the connection portion of the supply duct 400 with the damper assembly 500 or the freezing of the inside of the supply duct 400.

As illustrated in FIGS. 12 to 16, such a second heater 700 may be provided on the outer surface of the supply duct 400. Specifically, the second heater 700 may be configured as a coil heater and may be installed to be in contact with at least a portion of the outer surface of the supply duct 400 therealong. That is, when it is considered that the maintenance of the heater may be difficult when the heater is provided on the inner surface of the supply duct 400, the heater may be provided on the outer surface of the supply duct 400 such that the maintenance of the heater is easy and the installation of the heater is performed easily.

In the first and second ends of the supply duct 400, the second heater 700 may be installed to be located to be adjacent more to the connection portion of the supply duct 400 with the damper assembly 500. That is, when it is considered that condensate water is generated in a place having a large temperature difference, in the outer surface of the supply duct 400, condensate water is more likely to be generated gradually toward the connection portion of the supply duct 400 with the damper assembly 500, and is less likely to be generated gradually toward the connection portion of the supply duct 400 with the first grille assembly 200 due to temperature higher than a dew point temperature. In consideration of this, the second heater 700 is preferably located as much as possible at the connection portion of the supply duct 400 with the damper assembly 500.

Particularly, the second heater 700 may be installed to have at least a portion located at an edge formed on the connection portion of the supply duct 400 with the damper assembly 500 in the outer surface of the supply duct 400.

That is, the second heater 700 may be located at a portion at which condensate is most likely to occur such that the condensate generated in the associated portion can be prevented from freezing. Furthermore, the edge is a bent portion, and thus even if a structure for restraining the second heater 700 is not installed on the outer surface of the supply duct 400, the second heater 700 configured as the coil heater may maintain a precisely installed state thereof. Accordingly, the edge is most preferably the installation position of the second heater 700.

In addition, the second heater 700 may be installed to have at least a portion located on the center portion of the supply duct 400. That is, when it is considered that condensate water is generated in the center portion of the supply duct 400, the portion of the second heater 700 may be located in the associated portion such that the condensate water is prevented from freezing in the associated portion.

Furthermore, another portion of the second heater 700 is preferably installed along the upper surface of the supply duct 400. That is, the second heater 700 may be installed to be in more contact with the upper portion of the supply duct 400 than the lower portion of the supply duct 400 such that condensate water generated on the upper surface of the inside of the supply duct 400 can be prevented from freezing. In this case, the portion of the second heater 700 ranging from the edge of a first end of the supply duct 400 to the center portion of the supply duct 400 may be configured to be installed along the upper surface of the supply duct 400.

In addition, the first heater 600 may be configured to have a higher output value than the second heater 700. That is, the second heater 700 may function to assist the first heater 600 such that power consumption can be reduced as much as possible.

Of course, in the refrigerator according to the embodiment of the present disclosure, only the first heater 600 may be provided or only the second heater 700 may be provided.

However, when only the first heater 600 is provided, the first heater 600 is required to generate heat with a sufficiently high output so as to prevent the freezing of the inside of the supply duct 400, so power consumption may be high and may affect the temperature of the second storage compartment 131.

Furthermore, the second heater 700 may be provided on the outer surface of the supply duct 400, and thus when only the second heater 700 is provided, it may be difficult to effectively prevent the freezing of the damper 520. Furthermore, to prevent the freezing of the damper 520, the second heater 700 is required to generate heat with high output. In this case, excessive heat may be unnecessarily supplied to the center portion of the supply duct 400, so power consumption may be inevitably increased.

In consideration of this, it is most advantageous that both the first heater 600 and the second heater 700 are provided for freezing prevention and power consumption reduction.

Figure 18:
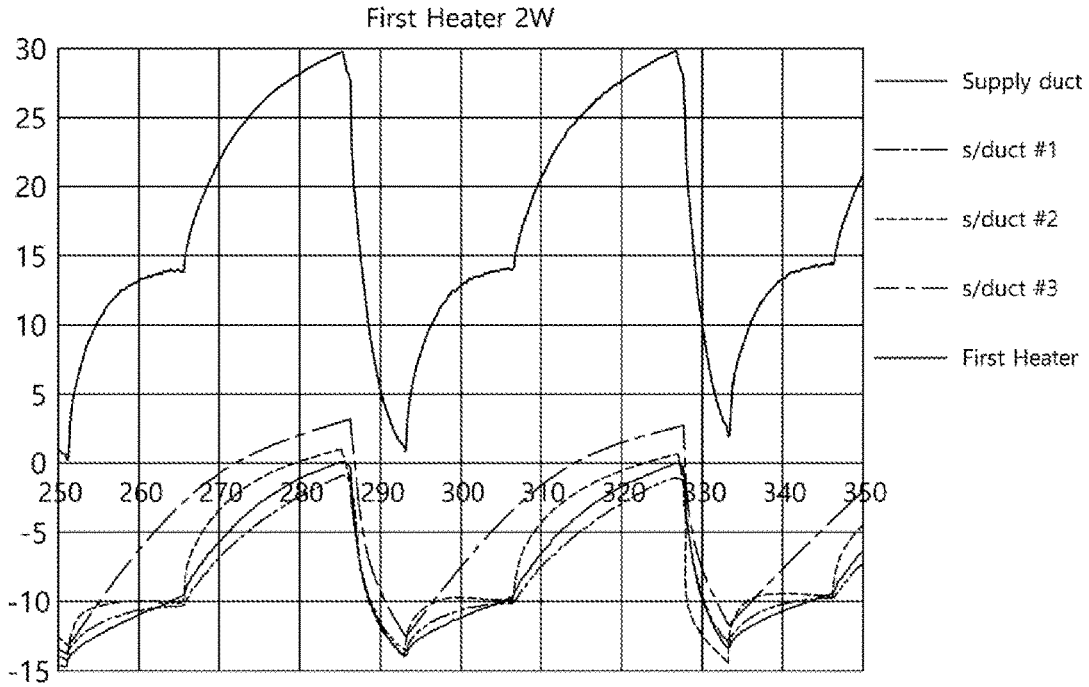
FIG. 18 is a graph illustrating the temperature change of each part of the supply duct when only a first heater is provided in the refrigerator according to the embodiment of the present disclosure.

For example, as can be seen from the graph of FIG. 18, when only the first heater 600 is provided, the surface temperature of the center portion or first end (the connection portion of the supply duct 400 with the first grille assembly) of the supply duct 400 may be lower than the temperature of the internal space of the supply duct 400, and thus condensate water is likely to be generated.

Figure 19:
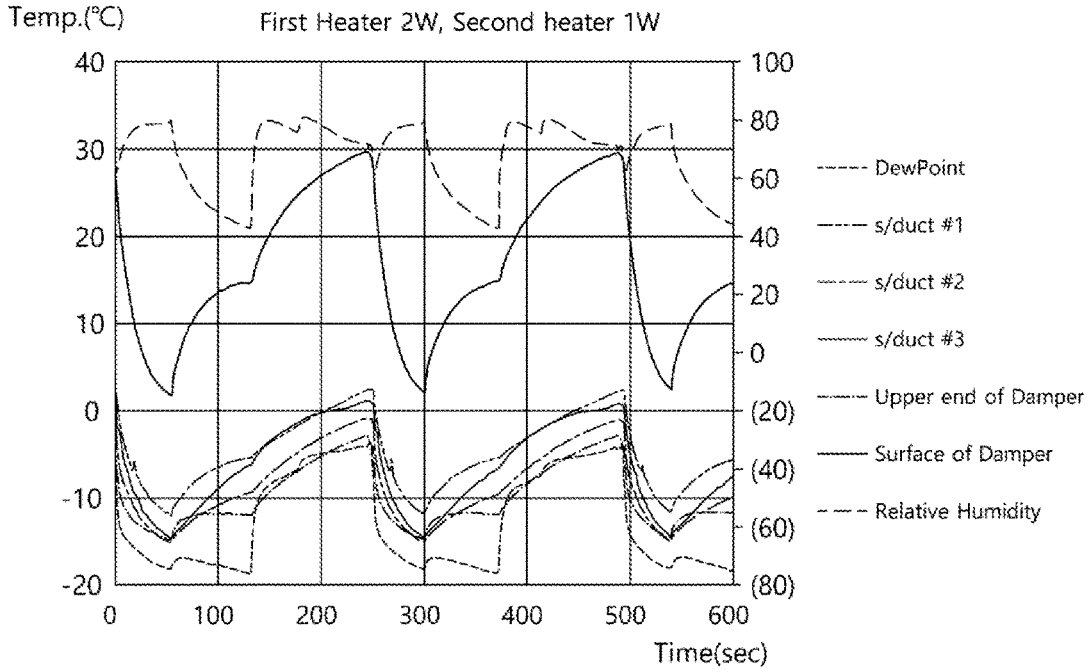
FIG. 19 is a graph illustrating the temperature change of each part of the supply duct when the first heater and the second heater are provided in the refrigerator according to the embodiment of the present disclosure.

Furthermore, as can be seen from the graph of FIG. 19, when both the first heater 600 and the second heater 700 are provided, the temperature of the internal space of the supply duct 400 and the surface temperature of each portion of the supply duct 400 may be higher than a dew point temperature, so condensate water may be prevented from being generated.

In this case, s/duct 1 of each graph described above is the inlet portion (the connection portion of the supply duct 400 with the second grille assembly) of the supply duct 400; s/duct 2 is the center portion of the supply duct 400; and s/duct 3 is the outlet portion (the connection portion of the supply duct 400 with the first grille assembly) of the supply duct 400.

Meanwhile, when the damper 520 operates to open the passing flow path 501, the first heater 600 and the second heater 700 may be controlled to stop heating. That is, in a state in which the damper 520 opens the passing flow path, the temperature of cold air of the first grille assembly 200 may not be affected through the supply duct 400.

Furthermore, in a case in which the damper 520 is maintained to close the passing flow path 501, when room temperature RT is within a first preset temperature range, the first heater 600 and the second heater 700 may be controlled to repeatedly perform and stop heating for a preset period of time. In this case, the first preset temperature range as a normal room temperature range may be the temperature of $12.5<RT\leq23.0°$ C.

Additionally, when the room temperature RT is within a second preset temperature range, the first heater 600 and the second heater 700 may be controlled such that the first heater 600 and the second heater 700 are maintained to continue heating. In this case, the second preset temperature range may be the temperature of RT 12.5° C. lower than the first preset temperature range. That is, when the room temperature is low, the internal temperature of each of the storage compartments may be maintained at an excessively low temperature, and accordingly, each of the heaters 600 and 700 may generate heat to prevent the internal temperature of the storage compartment from decreasing excessively.

Additionally, when the room temperature RT is within a third preset temperature range, the first heater 600 and the second heater 700 may be controlled to repeatedly perform and stop heating for a preset period of time. In this case, the third preset temperature range may be the temperature of 23° C.<RT higher than the first preset temperature range.

Particularly, heating interruption time when the room temperature RT is within the first preset temperature range may be preset to be shorter than heating interruption time when the room temperature RT is within the third preset temperature range. That is, when the room temperature RT is relatively high, the supply duct 400 may be affected by the room temperature RT conducted through the outer casing 110, and accordingly, the heating interruption time may be maintained longer to reduce power consumption.

Of course, when the first heater 600 and the second heater 700 operate under a special condition during the operation of the refrigerator, at least one heater 600 or 700 may generate heat by control different from the above-described control.

For example, during the error occurrence of one sensor related to the defrosting operation in a case in which the refrigerator is initially powered on, or in a case in which the internal temperature of at least one storage compartment 121 or 131 is lower than the lower limit reference temperature NT-Diff, when the indoor humidity is 80% or more, the ice making or separating of at least one ice maker may be included in the special condition.

Figure 17:
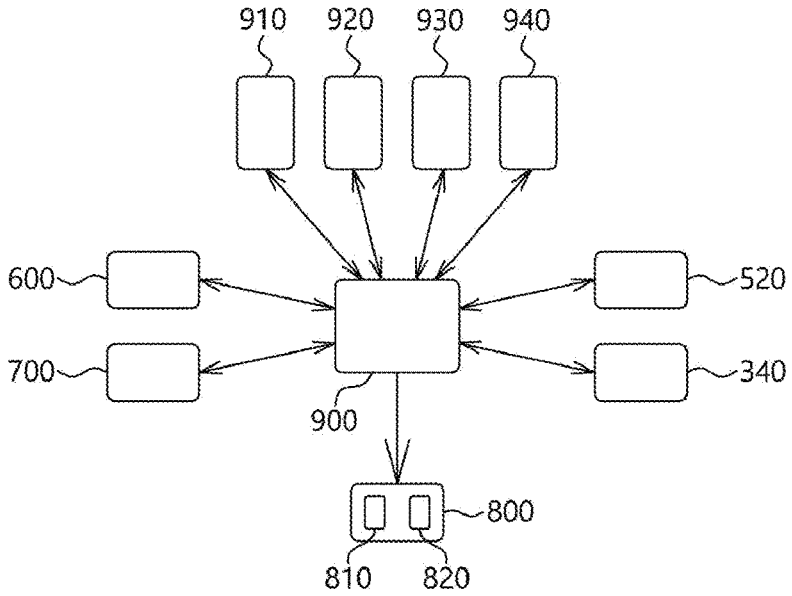
FIG. 17 is a block diagram approximately illustrating a controller of the refrigerator according to the embodiment of the present disclosure.

Meanwhile, as illustrated in FIG. 17, the refrigerator according to the embodiment of the present disclosure may be configured to be operated by the control of a controller 900.

Here, the controller 900 may control a refrigeration system 800 including the evaporator 810 and a compressor 820 to generate cold air.

Furthermore, the controller 900 may check the internal temperatures obtained from temperature sensors 910 and 920 located in the storage compartments 121 and 131, respectively, and then may control each of the internal temperatures by controlling the operations of the damper 520 and the blower fan 340 on the basis of the checked internal temperatures.

Furthermore, the controller 900 may check the internal temperature, the room temperature, and the indoor humidity obtained from the temperature sensor 910 and 920 located in the storage compartments 121 and 131, respectively, a temperature sensor 930 which measures the room temperature, and a humidity sensor 940 which measures the indoor humidity, and may control the operation of each of the heaters 600 and 700 to prevent the freezing of the damper 520 and the supply duct 400.

Hereinafter, the operation control process of the refrigerator according to the embodiment of the present disclosure described above and the operation of each component of the refrigerator due to such control will be described more in detail.

First, when the performance condition of cooling operation (operation for supplying cold air) is satisfied (when the internal temperature of at least one storage compartment belongs to an unsatisfactory temperature), the refrigeration system including the evaporator 810 and the blower fan 340 may operate.

In addition, when such cooling operation is performed, the controller 900 which controls the operation of the refrigerator may control the operation of the damper 520 according to the internal temperature of each of the storage compartments 121 and 131.

For example, when the internal temperature of the first storage compartment 121 belongs to the unsatisfactory temperature which is temperature higher than an upper limit reference temperature NT+Diff specified on the basis of the preset reference temperature NT, cold air may be controlled to be supplied to the first storage compartment 121.

Accordingly, in order to supply cold air to the first storage compartment 121, the damper 520 may be opened such that the passing flow path 501 and the supply flow path 401 are controlled to communicate with each other. Accordingly, cold air passing through the evaporator 810 due to the operation of the blower fan 340 may be introduced to space between the second duct plate 320 and the shroud 330 of the second grille assembly 300, may continuously pass sequentially through the passing flow path 501 of the damper assembly 500 and the supply flow path 401 of the supply duct 400, and may be supplied to the first storage compartment 121.

In this case, while the cold air passes sequentially through the passing flow path 501 and the supply flow path 401, power supply to the first heater 600 and the second heater 700 may be controlled to be cut off. Accordingly, the temperature of the cold air supplied to the first storage compartment 121 may be prevented from increasing unintentionally.

Particularly, while the cold air flows through the passing flow path 501 into the supply flow path 401, some of the flowing cold air may hit the reverse step 402 which exists in the associated portion. Accordingly, even if condensate water exists on the reverse step 402, the condensate water may be removed by the cold air, so the formation of frost due to condensate water may be prevented.

Furthermore, condensate water generated in the supply duct 400 may flow down the wall surface of the inside of the supply duct 400. In this process, while the condensate water flows along the guide rib 430 formed on the internal wall surface of the supply duct 400, the condensate water may be transferred to the first storage compartment 121. In this case, since the first storage compartment 121 is maintained at temperature higher than dew point temperature, the condensate water transferred to the first storage compartment 121 may be prevented from freezing.

Additionally, when the internal temperature of the first storage compartment 121 reaches temperature (for example, NT-Diff) in a satisfactory temperature NT±Diff relative to the preset reference temperature NT, cold air supply to the first storage compartment 121 may stop. That is, the damper 520 may be controlled to close the passing flow path 501.

When the internal temperature of the first storage compartment 121 belongs to the satisfactory temperature but the internal temperature of the second storage compartment 131 belongs to the unsatisfactory temperature (temperature exceeding NT+Diff), cold air may be controlled to be supplied to the second storage compartment 131.

Accordingly, when supplying cold air to the second storage compartment 131, the damper 520 may be controlled to close the passing flow path 501. Accordingly, cold air passing through the evaporator 810 due to the operation of the blower fan 340 may be introduced to space between the second duct plate 320 and the shroud 330 of the second grille assembly 300, and then may be supplied through each of the second cold discharge holes 311 of the second grille panel 310 to the second storage compartment 131.

Particularly, as described above, in the state in which the damper 520 closes the passing flow path 501, the passing flow path 501 may be affected by the temperature of the second storage compartment 131, but the supply flow path 401 inside the supply duct 400 may be affected by the temperature of the first storage compartment 121.

Here, when it is considered that the second storage compartment 131 is maintained at temperature lower than the temperature of the first storage compartment 121, due to temperature difference therebetween, dew (condensate water) may be generated on the surface of the damper 520, on the damper cover 510, or on the inside of the supply duct 400. In this case, dew generated inside the passing flow path of the damper cover 510 may be naturally removed by dry cold air. However, in the supply duct 400, dew may be continuously generated due to humid air in the second storage compartment 131, and in this process, the dew may be frozen by cold heat conducted from the damper assembly 500.

In consideration of this, as described above, when the damper 520 closes the passing flow path 501, at least one heater of the first heater 600 and the second heater 700 may be controlled to periodically generate heat.

The first heater 600 and the second heater 700 may be controlled to generate heat at the same time, and only one heater thereof may be controlled to generate heat. However, it is preferable that the two heaters 600 and 700 are controlled to simultaneously generate heat so as to sufficiently defrost an entire portion inside the supply duct 400.

Accordingly, due to the heating of the first heater 600 and the second heater 700 described above, the damper assembly 500, the supply duct 400, and the connection portion of the damper assembly 500 with the supply duct 400 may be prevented from freezing.

Particularly, the first heater 600 and the second heater 700 may stop heating for a longer period of time when room temperature RT is within the second preset temperature range rather than the first preset temperature range so as to minimize power consumption.

Of course, under at least one condition of special conditions below, at least one heater of the first heater 600 and the second heater 700 may be controlled to continuously generate heat regardless of the opening/closing of the passing flow path by the damper 520.

For example, when the refrigerator is initially powered on, at least one heater 600 or 700 may generate heat for a predetermined period of time regardless of the opening/closing of the passing flow path by the damper 520.

In addition, when the internal temperature of at least one storage compartment of the first storage compartment 121 and the second storage compartment 131 is lower than the lower limit reference temperature NT-Diff of the satisfactory temperature NT±Diff designated relative to the preset reference temperature NT, at least one heater 600 or 700 may generate heat such that the internal temperature reaches the satisfactory temperature.

Additionally, during the occurrence of the error of one sensor related to the defrosting operation provided in the refrigerator, at least one heater 600 or 700 may generate heat to prevent the freezing of the evaporator 810 or each portion.

In addition, when the indoor humidity is higher than humidity preset at high humidity, any one heater 600 or 700 may generate heat. In this case, the indoor humidity may be humidity of the surrounding area of the refrigerator, and the preset humidity may be relative humidity of at least 80%. That is, in a very humid summer (for example, a rainy season), when the surrounding area of the refrigerator is maintained in a high humidity state, there is a high risk of freezing in the surrounding area, and thus at least one heater 600 or 700 may be controlled to generate heat.

Furthermore, when a defrost operation condition for the evaporator 810 of the associated refrigerator is satisfied (for example, when a compressor's operating integration time exceeds a preset time), at least one heater 600 or 700 may generate heat.

Additionally, in the case of a refrigerator in which an ice making compartment is provided in one refrigerator door 122 or 132, during the ice making or ice separation of at least one of the ice maker (not shown) of the associated ice making compartment and an ice maker (not shown) in the second storage compartment 131, at least one heater 600 or 700 may generate heat.

After all, in the refrigerator of the present disclosure, the first heater 600 may be provided in the damper assembly 500, so the freezing of the damper assembly 500 or the freezing of the connection portion of the damper assembly 500 with the supply duct 400 may be prevented.

In addition, in the refrigerator of the present disclosure, the first heater 600 as a surface heating body may be installed along the surface of the damper 520, sufficient heat for defrosting may be supplied not only to the inside of the damper assembly 500 but also to the inside of the supply duct 400.

Additionally, in the refrigerator of the present disclosure, the second heater 700 may be provided in the supply duct 400, thereby preventing the freezing of the supply duct 400 or the connection portion of the supply duct 400 with the damper assembly 500.

Furthermore, in the refrigerator of the present disclosure, the second heater 700 may be configured as a coil heater and may be installed along the outer surface of the supply duct 400, thereby supplying sufficient heat for defrosting to the connection portion of the damper assembly 500 with the supply duct 400 and to the inside of the supply duct 400.

In addition, in the refrigerator of the present disclosure, the reverse step 402 which some of flowing cold air hits may be formed in the communication portion of the supply flow path 401 with the passing flow path 501, thereby preventing freezing which may occur in the associated communication portion.

Additionally, in the refrigerator of the present disclosure, the guide rib 430 may be formed on the inner surface of the supply duct 400 by protruding therefrom, thereby allowing condensate water or defrost water generated in the supply duct 400 to flow down to the refrigerating compartment maintained at temperature higher than a dew point temperature.

Furthermore, in the refrigerator of the present disclosure, the first heater 600 and the second heater 700 may be controlled to generate heat only when the damper 520 is opened except under a special condition, thereby preventing impact on the internal temperature of each of the storage compartments 121 and 131 due to excessive heating operation of each of the heaters 600 and 700 and minimizing power consumption.

Meanwhile, the refrigerator of the present disclosure may be embodied in different forms.

For example, in the refrigerator of the present disclosure, the first heater 600 may not be provided, but only the second heater 700 may be provided.

Of course, when only the second heater 700 is provided, it is difficult to effectively prevent the freezing of the damper 520 as mentioned in the description of each of the heaters 600 and 700 according to the above-described embodiment, and due to heat generated by the high output of the second heater, power consumption is inevitably increased.

Figure 20:
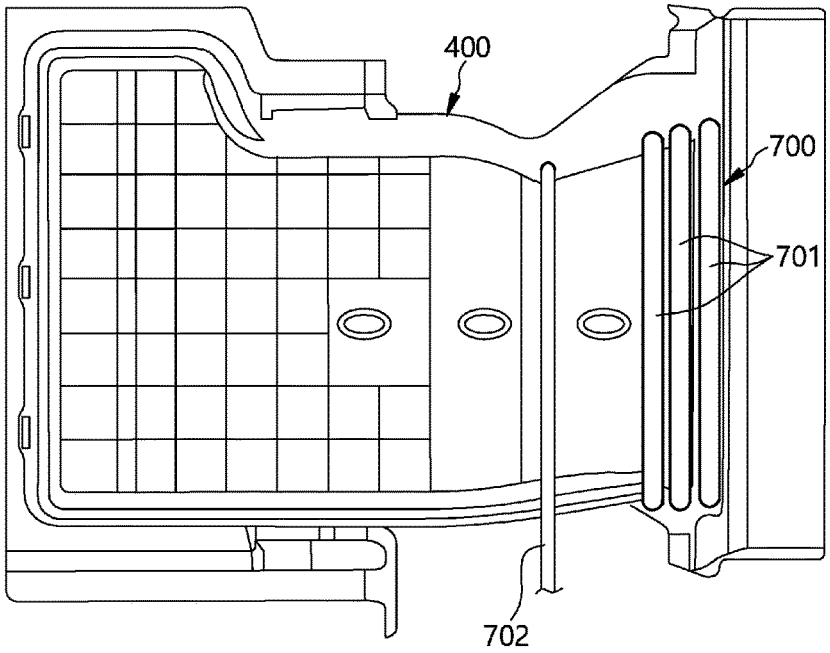
FIG. 20 is a view illustrating the state of the supply duct when only a plurality of second heaters is provided in the refrigerator according to the embodiment of the present disclosure.

However, when the second heater 700 includes a plurality of second heaters, the above-mentioned disadvantages may be solved. That is, one coil heater 701 having a relatively high output may be disposed on the connection portion of the supply duct 400 with the damper assembly which has high risk of freezing (or the connection portion of the supply duct 400 with the second grille assembly) in the outer surface of the supply duct 400, and another coil heater 702 having a relatively low output may be disposed on the center portion of the supply duct 400. This is illustrated in FIG. 20.

It is also possible to dispose a larger number of coil heaters 701 intensively on a part of the outer surface of the supply duct 400 on which there is the high risk of freezing.

Accordingly, the refrigerator of the present disclosure may be embodied in various forms.

Accordingly, the present disclosure has been made keeping in mind the above problems occurring in the related art, and the present disclosure is intended to propose a refrigerator in which a supply duct configured to guide the flow of cold air from one storage compartment to another storage compartment, and a damper configured to open/close the supply duct may be prevented from freezing.

In addition, the present disclosure is intended to propose a refrigerator in which defrost water generated in the supply duct may flow to the refrigerating compartment such that the defrost water may be prevented from being supplied to the freezer compartment to be frozen.

Furthermore, the present disclosure is intended to propose a refrigerator in which the surface temperature of the supply duct may be raised to prevent the freezing of the inside of the supply duct.

Additionally, the present disclosure is intended to propose a refrigerator in which a heater may be provided to prevent the freezing of the damper, and impact which the operation of the heater affects the internal temperature of the refrigerating compartment may be minimized such that power consumption is minimized.

In order to achieve the above objectives, according to one aspect of the present disclosure, there is provided a refrigerator in which at least one of a damper assembly, a supply duct, and the connection portion of the damper assembly with the supply duct may be heated. Accordingly, the malfunction of the damper may be prevented.

According to the refrigerator of the present disclosure, a first heater which prevents the freezing of the damper assembly or the connection portion of the damper assembly with the supply duct may be prevented.

According to the refrigerator of the present disclosure, the first heater may be provided in the damper assembly or the connection portion of the damper assembly with the supply duct.

In addition, according to the refrigerator of the present disclosure, the supply duct may include a second heater which prevents the freezing of the connection portion of the supply duct with the damper assembly or the inside of the supply duct.

In addition, according to the refrigerator of the present disclosure, the cold air introduction portion of a supply flow path may be configured to be smaller than the cold air discharge portion of a passing flow path.

In addition, according to the refrigerator of the present disclosure, a step may be formed at the connection portion of the cold air introduction portion of the supply flow path with the cold air discharge portion of the passing flow path.

In addition, according to the refrigerator of the present disclosure, the upper portion of the cold air introduction portion of the supply flow path may be located at a position lower than the upper portion of the cold air discharge portion of the passing flow path.

In addition, according to the refrigerator of the present disclosure, the step may be formed to be larger than an assembly tolerance.

In addition, according to the refrigerator of the present disclosure, the step may be formed to be within 5 mm.

In addition, according to the refrigerator of the present disclosure, a guide rib which guides the flow of defrost water may be formed on the inner surface of the supply duct such that the guide rib is inclined or rounded.

In addition, according to the refrigerator of the present disclosure, the guide rib may be configured to have the protrusion height of 1.5 mm to 2 mm. Accordingly, resistance against the flow of cold passing through the supply flow path may be minimized and defrost water may be accurately guided.

In addition, according to the refrigerator of the present disclosure, the first heater may be provided on the outer surface of the damper.

In addition, according to the refrigerator of the present disclosure, the first heater may be configured as a surface heating body.

In addition, according to the refrigerator of the present disclosure, the first heater may be located on a surface of the outer surfaces of the damper directed to the supply duct.

In addition, according to the refrigerator of the present disclosure, the second heater may be provided on the outer surface of the supply duct.

In addition, according to the refrigerator of the present disclosure, the second heater may be configured as a coil heater.

In addition, according to the refrigerator of the present disclosure, the second heater may be installed on an edge formed on the connection portion of the supply duct with the damper assembly in the outer surface of the supply duct.

In addition, according to the refrigerator of the present disclosure, at least a portion of the second heater may be installed to be located at the center portion of the outer surface of the supply duct.

In addition, according to the refrigerator of the present disclosure, the second heater may be located to be adjacent to the connection portion of the supply duct with the damper assembly.

In addition, according to the refrigerator of the present disclosure, the second heater may be installed to be in more contact with the upper portion of the supply duct.

In addition, according to the refrigerator of the present disclosure, the first heater may be configured to have a higher output value than the second heater.

In addition, according to the refrigerator of the present disclosure, a controller which controls the heat generation of the first heater and the second heater may be included.

In addition, according to the refrigerator of the present disclosure, the controller may control at least one heater of the first heater and the second heater such that the at least one heater of the first heater and the second heater stops heating when the damper opens the passing flow path.

In addition, according to the refrigerator of the present disclosure, when the damper closes the passing flow path, the controller may control at least one heater of the first heater and the second heater such that the at least one heater of the first heater and the second heater continues heating, or repeatedly performs and stops heating according to room temperature outside the refrigerator.

In addition, according to the refrigerator of the present disclosure, when the room temperature is within a first preset temperature range, the controller may control at least one heater of the first heater and the second heater such that the at least one heater of the first heater and the second heater repeatedly performs and stops heating for a preset period of time.

In addition, according to the refrigerator of the present disclosure, when the room temperature is within a second preset temperature range lower than the first preset temperature range, the controller may control at least one heater of the first heater and the second heater such that the at least one heater of the first heater and the second heater is maintained to continue heating.

In addition, according to the refrigerator of the present disclosure, when the room temperature is within a third preset temperature range higher than the first preset temperature range, the controller may control at least one heater of the first heater and the second heater such that the at least one heater of the first heater and the second heater repeatedly performs and stops heating for a preset period of time.

In addition, according to the refrigerator of the present disclosure, heating interruption time when the room temperature is within the first preset temperature range may be preset to be shorter than heating interruption time when the room temperature is within the third preset temperature range.

In addition, according to the refrigerator of the present disclosure, when indoor humidity is higher than preset humidity, the controller may control at least one heater of the first heater and the second heater such that the at least one heater of the first heater and the second heater is maintained to continue heating.

In addition, according to the refrigerator of the present disclosure, when the refrigerator is under a special condition, the controller may control at least one heater of the first heater and the second heater such that the at least one heater of the first heater and the second heater generates heat regardless of whether the passing flow path is opened or closed by the damper.

As described above, the refrigerator of the present disclosure may have the following effects.

First, in the refrigerator of the present disclosure, the first heater may be provided in the damper assembly, thereby preventing the freezing of the damper assembly or the connection portion of the damper assembly with the supply duct.

In addition, in the refrigerator of the present disclosure, the first heater may be configured as a surface heating body and may be installed along the surface of the damper, thereby supplying sufficient heat for defrosting to the damper assembly and to the inside of the supply duct to prevent freezing thereof.

In addition, in the refrigerator of the present disclosure, the second heater may be provided in the supply duct, thereby preventing the freezing of the supply duct or the connection portion of the supply duct with the damper assembly.

In addition, in the refrigerator of the present disclosure, the second heater may be configured as a coil heater, and may be installed along the outer surface of the supply duct, thereby supplying sufficient heat to the connection portion of the damper assembly with the supply duct and to the inside of the supply duct to prevent freezing thereof.

In addition, in the refrigerator of the present disclosure, a reverse step with which some of flowing cold air hits may be formed in the communication portion of the supply flow path with the passing flow path, thereby preventing freezing which may occur in the associated communication portion.

In addition, in the refrigerator of the present disclosure, the guide rib may be formed on the inner surface of the supply duct by protruding therefrom, thereby allowing condensate water or defrost water generated in the supply duct to flow down to the refrigerating compartment maintained at temperature higher than a dew point temperature to prevent freezing.

In addition, in the refrigerator of the present disclosure, the first heater and the second heater may be controlled to generate heat only when the damper is opened except under a special condition, thereby preventing impact on the internal temperature of each of storage compartments due to the excessive heating operation of each of the heaters and minimizing power consumption.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a refrigerator body having a first inner casing to provide a first storage compartment, and a second inner casing to provide a second storage compartment;

a first grille assembly provided in the first inner casing and configured to guide air to the first storage compartment;

a second grille assembly provided in the second inner casing and configured to guide air passing through an evaporator such that the air is provided to the second storage compartment and to the first grille assembly;

a supply duct having a first end to couple to the first grille assembly and having a second end to couple to an outside surface of a second grille assembly wall of the second grille assembly so as to cover an opening of the second grille assembly wall, the supply duct having a supply flow path provided between the first end and the second end such that at least some of the air from the second grille assembly is provided to the first grille assembly;

a damper assembly including a damper cover at a connection area of the second grille assembly with the supply duct and having a passing flow path that corresponds to the supply flow path, and a damper at the passing flow path and configured to open/close the passing flow path, wherein the damper cover is disposed on an inside surface of the second grille assembly wall;

a first heater provided on an outer surface of the damper that faces the supply duct when the damper is closed, and configured to provide heat to a connection area of the damper assembly with the supply duct; and a second heater provided at the supply duct and configured to provide heat to the connection area of the supply duct with the damper assembly, wherein the supply duct includes a body part and a cover part coupled to form an inlet of the supply duct, and includes a connection part that extends away from the inlet and is coupled to the outside surface of the second grille assembly wall, wherein an air introduction portion of the supply flow path at the supply duct is formed by the inlet of the supply duct, and the air introduction portion corresponds to the opening of the second grille assembly wall, an air discharge portion of the passing flow path at the damper cover communicates with the air introduction portion of the supply flow path at the supply duct, and the air introduction portion of the supply flow path at the supply duct is configured to be smaller than the air discharge portion of the passing flow path at the damper cover such that a step is provided at a connection area of the air introduction portion of the supply flow path at the supply duct with the air discharge portion of the passing flow path at the damper cover.

2. The refrigerator of claim 1, wherein a portion of the air introduction portion of the supply flow path at the supply duct is provided lower than a portion of the air discharge portion of the passing flow path at the damper cover such that the step is provided at a connection area of the portion of the air introduction portion with the portion of the air discharge portion.

3. The refrigerator of claim 1, comprising a guide rib on an inner surface of the supply duct, the guide rib being configured to guide a flow of defrost liquid flowing toward the first grille assembly.

4. The refrigerator of claim 1, wherein the second heater is provided on a surface of the supply duct.

5. The refrigerator of claim 1, wherein the second heater is configured as a coil heater and is to be in contact with a surface of the supply duct.

6. The refrigerator of claim 1, wherein the second heater is installed to have at least a portion provided at the connection area of the supply duct with the damper assembly in an outer surface of the supply duct.

7. The refrigerator of claim 6, wherein the second heater is installed to have at least a portion provided at a center area of the outer surface of the supply duct.

8. The refrigerator of claim 1, wherein the second heater is installed to be located to be adjacent to the connection area of the supply duct with the damper assembly.

9. The refrigerator of claim 1, wherein the second heater is installed to be in contact with an upper portion of the supply duct.

10. A refrigerator comprising:

a supply duct to couple to a flow path of a second grille assembly provided at a second inner casing and configured to guide air to a first grille assembly provided at a first inner casing;

a damper assembly configured to open and close the flow path of the second grille assembly;

a first heater configured to provide heat to the damper assembly or a connection area of the damper assembly with the supply duct;

a second heater configured to provide heat to the connection portion of the supply duct with the damper assembly or to an inside of the supply duct; and a controller configured to control heating of the first heater and to control heating of the second heater, wherein when a damper opens the flow path, the controller is configured to control the first heater or the second heater to stop heating, wherein when a room temperature is within a first preset temperature range, the controller is configured to control at least one of the first heater and the second heater to repeatedly perform and stop heating for a preset period of time.

11. The refrigerator of claim 10, wherein when the damper closes the flow path, the controller is configured to control at least one of the first heater and the second heater to continue heating, or to repeatedly perform and stop heating based on a room temperature outside the refrigerator.

12. The refrigerator of claim 10, wherein when a room temperature is within a second preset temperature range lower than the first preset temperature range, the controller is configured to control at least one of the first heater and the second heater to continue heating.

13. The refrigerator of claim 12, wherein when a room temperature is within a third preset temperature range higher than the first preset temperature range, the controller is configured to control at least one of the first heater and the second heater to repeatedly stop and perform heating for a preset period of time.

14. The refrigerator of claim 10, wherein a heating interruption time when a room temperature is within the first preset temperature range is preset to be shorter than a heating interruption time when the room temperature is within a second preset temperature range.

15. The refrigerator of claim 10, wherein when indoor humidity is higher than humidity preset at high humidity, the controller is configured to control at least one of the first heater and the second heater to continue maintaining heating.

16. A refrigerator comprising:

a supply duct to couple to a flow path of a second grille assembly provided at a second inner casing and configured to guide air to a first grille assembly provided at a first inner casing;

a damper assembly configured to open and close the flow path of the second grille assembly;

a first heater configured to provide heat to the damper assembly or a connection area of the damper assembly with the supply duct;

a second heater configured to provide heat to the connection portion of the supply duct with the damper assembly or to an inside of the supply duct; and a controller configured to control heating of the first heater and to control heating of the second heater, wherein when a damper opens the flow path, the controller is configured to control the first heater or the second heater to stop heating, wherein when a room temperature is within a second preset temperature range lower than a first preset temperature range, the controller is configured to control at least one of the first heater and the second heater to continue heating.

* * * * *